US009132627B2

(12) United States Patent
Shinkawa et al.

(10) Patent No.: US 9,132,627 B2
(45) Date of Patent: Sep. 15, 2015

(54) LIQUID EJECTING DEVICE, INSPECTION METHOD, AND PROGRAM

(75) Inventors: Osamu Shinkawa, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 181 days.

(21) Appl. No.: 13/398,126

(22) Filed: Feb. 16, 2012

(65) Prior Publication Data

US 2012/0206518 A1 Aug. 16, 2012

(30) Foreign Application Priority Data

Feb. 16, 2011 (JP) ..... 2011-030459
Feb. 16, 2011 (JP) ..... 2011-030898

(51) Int. Cl.
*B41J 29/38* (2006.01)
*B41J 2/045* (2006.01)
*B41J 2/14* (2006.01)

(52) U.S. Cl.
CPC ..... *B41J 2/0451* (2013.01); *B41J 2/04581* (2013.01); *B41J 2002/14354* (2013.01)

(58) Field of Classification Search
USPC ..... 347/5, 9, 10, 19, 14
See application file for complete search history.

(56) References Cited

U.S. PATENT DOCUMENTS

| | | | | |
|---|---|---|---|---|
| 7,232,199 | B2 | 6/2007 | Shinkawa et al. | |
| 7,429,093 | B2 * | 9/2008 | Shinkawa | 347/19 |
| 7,597,417 | B2 | 10/2009 | Nagashima | |
| 2003/0090534 | A1 * | 5/2003 | Valero et al. | 347/19 |
| 2005/0212845 | A1 | 9/2005 | Shinkawa | |
| 2006/0038858 | A1 | 2/2006 | Ishizaki | |
| 2006/0066683 | A1 | 3/2006 | Hara | |
| 2006/0071964 | A1 | 4/2006 | Oku | |

FOREIGN PATENT DOCUMENTS

| | | | |
|---|---|---|---|
| EP | 1600294 | A1 | 11/2005 |
| JP | 2005-185942 | A | 7/2005 |
| JP | 2005-289048 | A | 10/2005 |
| JP | 2005-305992 | A | 11/2005 |
| JP | 2006-056058 | A | 3/2006 |
| JP | 2006-088577 | A | 4/2006 |
| JP | 2006-123539 | A | 5/2006 |
| WO | WO-2004/076180 | A1 | 9/2004 |

OTHER PUBLICATIONS

Extended European Search Report dated Jun. 11, 2012 for the corresponding European Patent Application No. 12155220.2.

* cited by examiner

*Primary Examiner* — Lam Nguyen
(74) *Attorney, Agent, or Firm* — Global IP Counselors, LLP

(57) ABSTRACT

A liquid ejecting device ejects a liquid using a driving element driven through application of a drive signal. The liquid ejecting device comprises a detector electrically connected to a plurality of driving elements via a common electrical path. The detector detects electrical signals output from each of the plurality of driving elements.

11 Claims, 11 Drawing Sheets

LIQUID EJECTING DEVICE, INSPECTION METHOD, AND PROGRAM

CROSS-REFERENCE TO RELATED APPLICATIONS

This application claims priority to Japanese Patent Application No. 2011-030459 filed on Feb. 16, 2011 and Japanese Patent Application No. 2011-030898 filed on Feb. 16, 2011. The entire disclosures of Japanese Patent Application Nos. 2011-030459 and 2011-030898 are hereby incorporated herein by reference.

BACKGROUND

1. Technical Field

The present invention relates to a technique for inspecting a plurality of ejectors in a liquid ejecting device.

2. Background Technology

An inkjet printer, which is one type of liquid ejecting device, is provided with a plurality of ejectors for ejecting ink. In each of the ejectors, ink is held in a cavity communicating with a nozzle, with the ink being ejected from the nozzle through driving by a driving element furnished to the cavity. In the ejectors of a liquid ejecting device of this kind, in a case where air bubbles have become entrained in the ink inside a cavity or where the ink inside a cavity has thickened, there is a risk of the nozzle clogging, so that ejection of ink from the nozzle cannot take place in a satisfactory manner.

In the past, there have been proposed techniques for inspecting for clogging of nozzles in the ejectors, on the basis of residual vibration of ink remaining in cavities, through driving of the driving element (for example, see Patent Citations 1 and 2).

Japanese Patent Application Publication Nos. 2005-289048 (Patent Citation 1) and 2005-305992 (Patent Citation 2) are examples of the related art.

SUMMARY

Problems to Be Solved by the Invention

However, in the past, sufficient consideration has not been given to the issue of improving process efficiency during inspection of a plurality of ejectors on the basis of a state, such as residual vibration, of a liquid inside cavities.

With the foregoing in view, it is an advantage of the present invention to provide a technique for improving process efficiency during inspection of a plurality of ejectors on the basis of the state of a liquid inside cavities.

Means Used to Solve the Above-Mentioned Problems

The present invention is arranged to address the aforementioned problem at least in part when realized through the following aspects.

(First Aspect) The liquid ejecting device of a first aspect resides in a liquid ejecting device for ejecting a liquid using driving elements driven through application of a drive signal, the liquid ejecting device including: a plurality of driving elements; a common electrical path electrically connected to the plurality of driving elements; and a detector electrically connected to the common electrical path; wherein the detector detects, via the common electrical path, electrical signals output from each of the plurality of driving elements.

(Second Aspect) In the liquid ejecting device according to the first aspect, the detector can detect, via the common electrical path, an electrical signal output by any of the plurality of driving elements.

(Third Aspect) In the liquid ejecting device according to the first or second aspect, the quantity of the plurality of driving elements undergoing detection of an electrical signal, via the common electrical path, when the application level of the drive signal is a first level can exceed the quantity of the plurality of driving elements undergoing detection of an electrical signal, via the common electrical path, when the application level of the drive signal is a second level that is stronger than the first level.

(Fourth Aspect) In the liquid ejecting device according to the first or second aspect, the application level of the drive signal when the quantity of the plurality of driving elements undergoing detection of an electrical signal via the common electrical path is a first quantity can be stronger than the application level of the drive signal when the quantity of the plurality of driving elements undergoing detection of an electrical signal via the common electrical path is a second quantity that is greater than the first quantity.

(Fifth Aspect) In the liquid ejecting device according to the first aspect, the plurality of driving elements can include a first driving element, a second driving element, and a third driving element; and the detector can detect, via the common electrical path, an electrical signal output from the first driving element and an electrical signal output from the second driving element; and can detect, via the common electrical path, an electrical signal output from the first driving element and an electrical signal output from the third driving element.

(Sixth Aspect) In the liquid ejecting device according to the fifth aspect, the detector can detect, via the common electrical path, an electrical signal output from the first driving element; and the application level of the drive signal applied to the first driving element in a case where an electrical signal output from the first driving element is detected can be greater than the application level of the drive signal applied to the first driving element in a case where an electrical signal output from the first driving element and an electrical signal output from the second driving element are detected.

(Seventh Aspect) In the liquid ejecting device according to the fifth or sixth aspect, the plurality of driving elements can include a fourth driving element; and the detector can detect, via the common electrical path, an electrical signal output from the first driving element and an electrical signal output from the fourth driving element.

(Eighth Aspect) In the liquid ejecting device according to the fifth or sixth aspect, the plurality of driving elements can include a fourth driving element; and the detector can detect, via the common electrical path, an electrical signal output from the third driving element and an electrical signal output from the fourth driving element.

(Ninth Aspect) The liquid ejecting device according to any of the first to eighth aspects can include a plurality of cavities; and cavities of driving elements that are not subjected to electrical signal detection via the common electrical path can be disposed between cavities for ejecting a liquid through driving of the plurality of driving elements that are subjected to electrical signal detection via the common electrical path.

(Tenth Aspect) In the liquid ejecting device according to any of the first to eighth aspects, liquids ejected by driving of the plurality of driving elements can be of the same type.

(Eleventh Aspect) The inspection method according to an eleventh aspect resides in a inspecting method by a liquid ejecting device that ejects a liquid using driving elements driven through application of a drive signal, the method including: the liquid ejecting device being provided with a plurality of driving elements, a common electrical path electrically connected to the plurality of driving elements, and a detector electrically connected to the common electrical path; driving the plurality of driving elements; and detecting, via the common electrical path, electrical signals that are output from each of the plurality of driving elements.

(Twelfth Aspect) The computer-readable media according to a twelfth aspect is a computer-readable media having stored thereon a computer program for prompting a computer to carry out a function for inspecting liquid ejection using a liquid ejecting device that ejects a liquid using driving elements driven by application of a drive signal, the liquid ejecting device being provided with a plurality of driving elements, a common electrical path electrically connected to the plurality of driving elements, and a detector electrically connected to the common electrical path; wherein the computer is prompted to carry out a function for driving the plurality of driving elements; and a function for detecting, via the common electrical path, electrical signals that are outputted from each of the plurality of driving elements.

(Thirteenth Aspect) The liquid ejecting device according to a thirteenth aspect is provided with a plurality of ejectors for ejecting a liquid inside cavities from nozzles communicating with the cavities, the liquid being ejected by driving of drive elements; a detector for detecting an electrical signal corresponding to a state of the liquid inside the cavities; and an inspecting section for inspecting the ejectors on the basis of the electrical signal, wherein the inspecting section inspects on the basis of a synthesized signal synthesized from a plurality of electrical signals in the plurality of ejectors. According to the liquid ejecting device of the thirteenth aspect, because the ejectors are inspected on the basis of a synthesized signal synthesized from a plurality of electrical signals, process efficiency can be improved during inspection of the ejectors.

(Fourteenth Aspect) In the liquid ejecting device according to the thirteenth aspect, the inspecting section can inspect the plurality of ejectors on the basis of the synthesized signal. According to the liquid ejecting device of the fourteenth aspect, because the plurality of ejectors are inspected collectively on the basis of a synthesized signal, the speed of the process needed for inspection can be improved, as compared with the case where the ejectors are inspected individually. As a result, process efficiency can be improved during inspection of the ejectors.

(Fifteenth Aspect) The liquid ejecting device according to the fourteenth aspect can further including: a plurality of sensors for outputting the electrical signal in each of the plurality of ejectors; and a common electrical path through which the electrical signals output from the plurality of sensors are applied in common; and the detector can detect the synthesized signal from the common electrical path. According to the liquid ejecting device of the fifteenth aspect, the synthesized signal can be readily detected.

(Sixteenth Aspect) In the liquid ejecting device according to the fourteenth or fifteenth aspect, in a case where the states of the plurality of ejectors cannot be identified by the inspecting section on the basis of the synthesized signal, the detectors can detect the electrical signal in every ejector among the plurality of ejectors; and the inspecting section, on the basis of the electrical signal detected for every ejector, can inspect each of the ejectors among the plurality of ejectors. According to the liquid ejecting device of the sixteenth aspect, ejectors whose state cannot be identified from the synthesized signal can be inspected individually on the basis of the electrical signal in each ejector, to determine the state thereof.

(Seventeenth Aspect) The liquid ejecting device according to any of the fourteenth to sixteenth aspects can further include a synthesis quantity modifier for modifying the quantity of the electrical signals to be synthesized, in accordance with the application level of a drive signal for driving the driving elements when the synthesized signal is detected. According to the liquid ejecting device of the seventeenth aspect, a synthesized signal of a signal level appropriate for inspection can be obtained.

(Eighteenth Aspect) The liquid ejecting device according to any of the fourteenth to seventeenth aspects can further be provided with an application level modifier for modifying, in accordance with the quantity of the electrical signals to be synthesized, the application level of a drive signal for driving the driving elements when the synthesized signal is detected. According to the liquid ejecting device of the eighteenth aspect, a synthesized signal of a signal level appropriate for inspection can be obtained.

(Nineteenth Aspect) In the liquid ejecting device according to the thirteenth aspect, the synthesized signal can be synthesized from an electrical signal of a first ejector in a liquid-ejection-enabled state among the plurality of ejectors, and an electrical signal of a second ejector different from the first ejector among the plurality of ejectors; and the inspecting section can inspect the second ejector on the basis of the synthesized signal. According to the liquid ejecting device of the nineteenth aspect, because the synthesized signal employed for inspection is a signal synthesized with an electrical signal showing a liquid-ejection-enabled state, thereby amplifying the signal level thereof above that of the electrical signal under inspection, erroneous decision during inspections can be minimized.

(Twentieth Aspect) In the liquid ejecting device according to the nineteenth aspect, prior to inspection of the second ejector, the inspecting section can identify the first ejector on the basis of an electrical signal detected by the detectors; and the application level of the drive signal for driving the driving element in the first ejector the first ejector is identified can be greater than the application level of the drive signal for driving the driving elements in each of the first and second ejectors when the second ejector is inspected. According to the liquid ejecting device of the twentieth aspect, erroneous decision during inspections of the first ejector can be minimized.

(Twenty-first Aspect) In the liquid ejecting device according to the nineteenth or twentieth aspect, in a case where the second ejector has been identified as being in a liquid-ejection-enabled state, the inspecting section can inspect a third ejector different from the first and second ejectors among the plurality of ejectors, on the basis of a synthesized signal synthesized from an electrical signal of the second ejector and an electrical signal of the third ejector. According to the liquid ejecting device of the twenty-first aspect, the load associated with driving in the plurality of ejectors can be balanced.

(Twenty-second Aspect) In the liquid ejecting device according to the nineteenth or twentieth aspect, after the second ejector has been inspected, the inspecting section can inspect a third ejector different from the first and second ejectors among the plurality of ejectors, on the basis of a synthesized signal synthesized from an electrical signal of the first ejector and an electrical signal of the third ejector. According to the liquid ejecting device of the twenty-second aspect, the second and third ejectors can be inspected under identical conditions.

(Twenty-third Aspect) In the liquid ejecting device according any of the thirteenth to twenty-second aspects, the state of the liquid inside the cavity can correspond to residual vibration of the liquid inside the cavity, which vibration is caused to remain by the driving of the driving element. According to the liquid ejecting device of the twenty-third aspect, process efficiency can be improved during inspection of the plurality of ejectors on the basis of residual vibration.

(Twenty-fourth Aspect) In the liquid ejecting device according any of the thirteenth to twenty-third aspects, other ejectors different from the plurality of ejectors can be disposed between each of the ejectors among the plurality of ejectors. According to the liquid ejecting device of the twenty-fourth aspect, the likelihood that sets of ejectors under inspection will affect one another can be minimized.

(Twenty-fifth Aspect) In the liquid ejecting device according any of the thirteenth to twenty-fourth aspects, the plurality of ejectors can eject the same type of liquid. According to the liquid ejecting device of the twenty-fifth aspect, a complex algorithm for analyzing the synthesized signal can be avoided, as compared with cases in which, owing to the fact that different types of liquid have respectively different characteristics, sets of a plurality of ejectors that respectively eject different types of liquid are under inspection.

(Twenty-sixth Aspect) The inspection method of a twenty-sixth aspect is an inspection method for inspecting a plurality of ejectors for ejecting a liquid inside cavities from nozzles communicating with the cavities, the liquid being ejected by driving of driving elements, wherein the inspection method includes: a detection step for detecting electrical signals corresponding to a state of the liquid inside the cavities; and an inspection step for inspecting the ejectors on the basis of the electrical signals; the inspection step involving inspection on the basis of a synthesized signal synthesized from a plurality of electrical signals in the plurality of ejectors. According to the inspection method of the twenty-sixth aspect, because the ejectors are inspected on the basis of a synthesized signal synthesized from a plurality of electrical signals, process efficiency can be improved during inspection of the ejectors.

(Twenty-seventh Aspect) The computer-readable media of the twenty-seventh aspect is a computer-readable media having stored thereon a computer program for prompting a computer to carry out a function for inspecting a plurality of ejectors for ejecting a liquid inside cavities from nozzles communicating with the cavities, the liquid being ejected by driving of driving elements, the program carrying out: a detection function for detecting electrical signals corresponding to a state of the liquid inside the cavities; and an inspection function for inspecting the ejectors on the basis of the electrical signals; wherein the inspection function involves inspection based on a synthesized signal synthesized from a plurality of electrical signals in the plurality of ejectors. According to the program of the twenty-seventh aspect, because the ejectors are inspected on the basis of a synthesized signal synthesized from a plurality of electrical signals, process efficiency can be improved during inspection of the ejectors.

BRIEF DESCRIPTION OF THE DRAWINGS

Referring now to the attached drawings which form a part of this original disclosure.

DETAILED DESCRIPTION OF EXEMPLARY EMBODIMENTS

A fuller understanding of the configuration and effect of the present invention described above will be apparent from the following description of a liquid ejecting device in which the invention is implemented.

Figure 1:
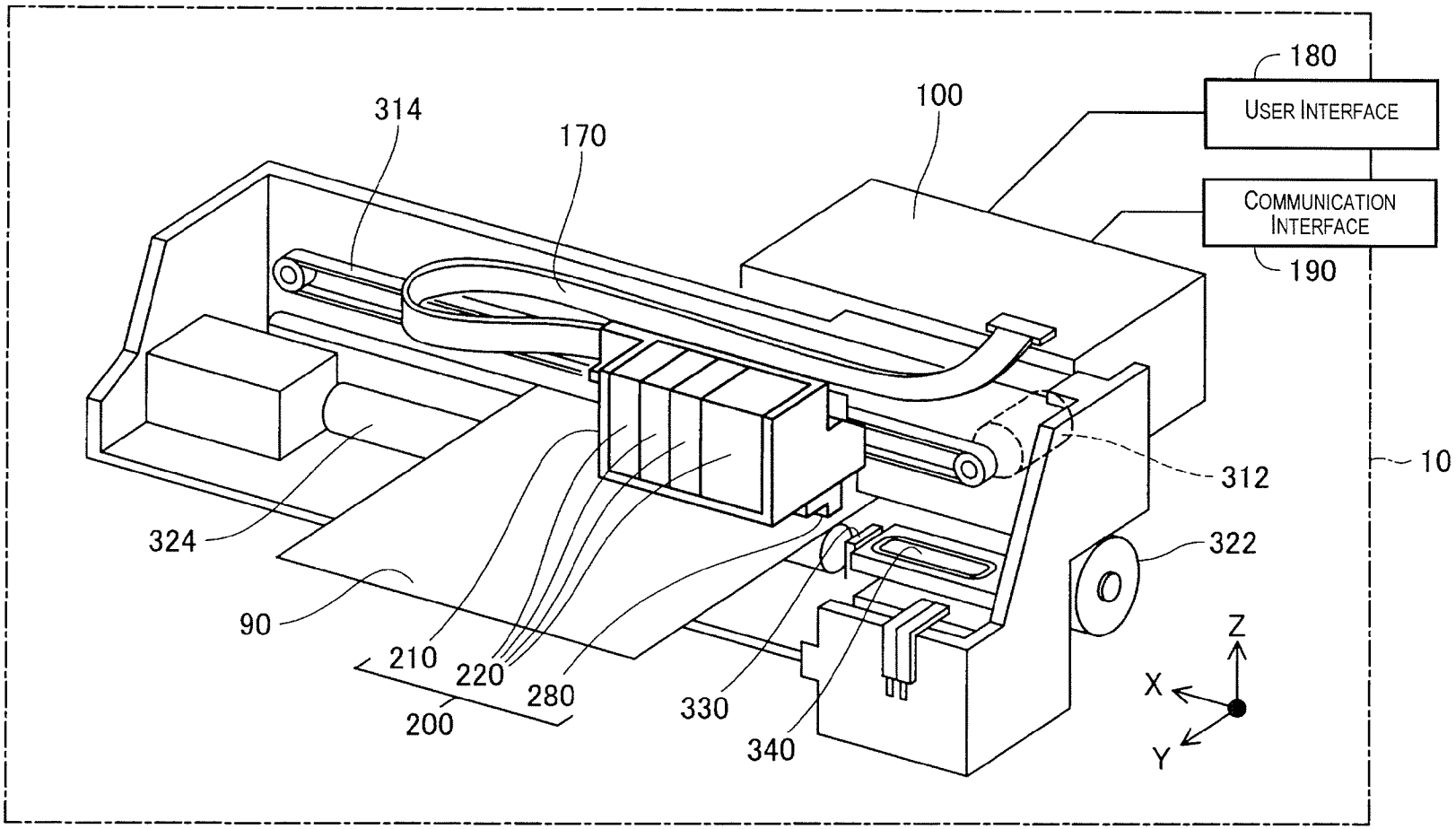
FIG. 1 is a descriptive diagram showing a configuration of a printer.

A. First Embodiment:

A1. Printer Configuration:

FIG. 1 is a descriptive diagram showing a configuration of a printer 10. The printer 10 is an inkjet printer which is one type of liquid ejecting device for ejecting a liquid; by ejecting ink as the liquid, the device prints data such as text, graphics, pictures, or the like, onto a printing medium 90 such as paper, labels, or the like. The printer 10 is provided with a controller 100, a user interface 180, a communication interface 190, and a head unit 200.

The user interface 180 of the printer 10 is provided with a display and manual operation buttons, and performs exchange of information with the user of the printer 10. The communication interface 190 performs exchange of information with external devices electrically connectable to the printer 10, such as personal computers, digital still cameras, memory cards, and the like. The head unit 200 of the printer 10 is provided with an ink ejecting mechanism for ejecting ink. The ink ejecting mechanism is discussed in detail below.

The controller 100 of the printer 10 controls each section of the printer 10. For example, on the basis of data input via the communication interface 190, the controller 100 performs control to bring about relative motion of the print unit 200 and the printing medium 90, while ejecting drops of ink from the head unit 200. Printing of the printing medium 90 is carried out thereby.

In the present embodiment, the controller 100 is a device provided with a CPU (Central Processing Unit), a ROM (Read Only Memory), a RAM (Random Access Memory), an input/output interface, and the like, the various functions of the controller 100 being carried out through operations of the CPU on the basis of a computer program. At least some of the functions of the controller 100 can be carried out through operations based on a circuit configuration of an electrical circuit provided to the controller 100.

In the present embodiment, the head unit 200 is provided with a carriage 210, ink cartridges 220, and a head 280. The carriage 210 of the head unit 200 is connected via a flexible cable 170 to the controller 100, a configuration whereby it is possible for the ink cartridges 220 and the head 280 to move while mounted thereon. The ink cartridges 220 of the head unit 200 contain ink inside, and supply this ink to the head 280. In the present embodiment, a plurality of ink cartridges 220 prepared for each color of ink (the four colors black, cyan, magenta, and yellow) are mounted on the carriage 210. The head 280 of the head unit 200 is a region facing the printing medium 90, and the ink supplied to the head 280 from the ink cartridges 220 is ejected in drop form towards the printing medium 90 from the head 280.

In the present embodiment, the printer 10 is provided with a main scanning mechanism and a sub-scanning mechanism for bringing about relative movement of the head unit 200 and the printing medium 90. The main scanning mechanism of the printer 10 is provided with a carriage motor 312 and a drive belt 314, and transmits motive force of the carriage motor 312 to the head unit 200 via the drive belt 314 to bring about reciprocating movement of the head unit 200 in the main scanning direction. The sub-scanning mechanism of the printer 10 is provided with a conveyor motor 322 and a platen 324, and through transmission of motive force of the conveyor motor 322 to the platen 324 conveys the printing medium 90 in a sub-scanning direction intersecting the main scanning direction. The carriage motor 312 of the main scanning mechanism and the conveyor motor 322 of the sub-scanning mechanism operate on the basis of control signals from the controller 100.

In the description of the present embodiment, an X axis is established along a coordinate axis in the main scanning direction in which the head unit 200 undergoes reciprocating motion; a Y axis is established along a coordinate axis in the sub-scanning direction in which the printing medium 90 is conveyed; and an X axis is established along a coordinate axis oriented upward from below in the direction of gravity. The X axis, the Y axis, and the Z axis are coordinate axes respectively orthogonal to one another.

Figure 2:
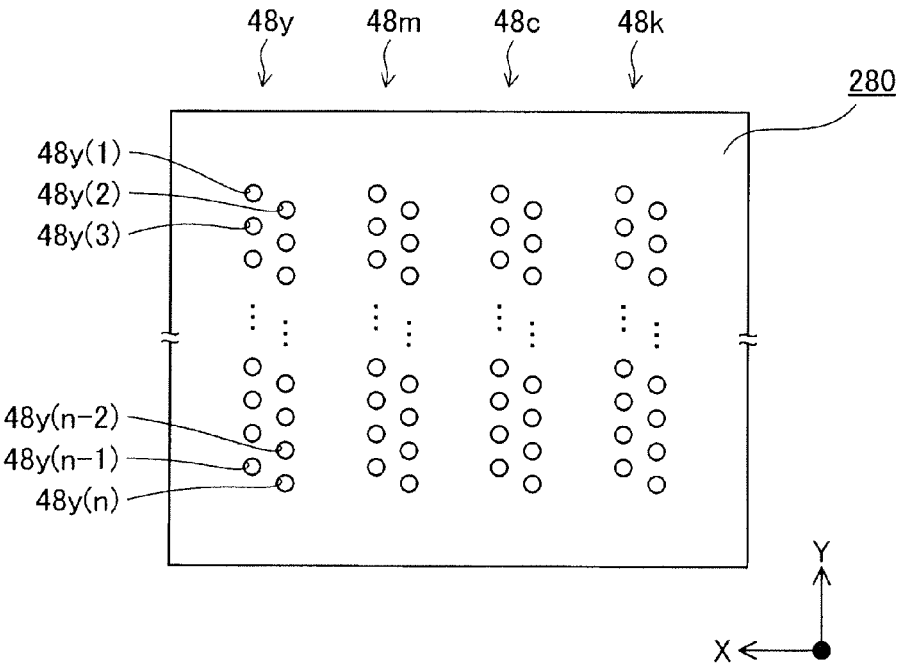
FIG. 2 is a descriptive diagram showing construction of the head in the head unit.

FIG. 2 is a descriptive diagram showing construction of the head 280 in the head unit 200. FIG. 2 shows the head 280 seen from the printing medium 90 side. The head 280 of the head unit 200 is provided with a plurality of nozzles 48 for ejecting ink. In the present embodiment, a number n (for example, 180) of nozzles 48 are furnished for each color of ink (the four colors black, cyan, magenta, and yellow), with the nozzles 48 for each color disposed in the order black, cyan, magenta, yellow in the main scanning direction (X axis direction). The nozzles 48 for each color are arrayed in mutually staggered fashion in the sub-scanning direction (Y axis direction), and in the present embodiment, are arrayed over two rows which alternate in the sub-scanning direction (Y axis direction), in order to narrow the gap between the nozzles 48 in the sub-scanning direction (Y axis direction).

Figure 3:
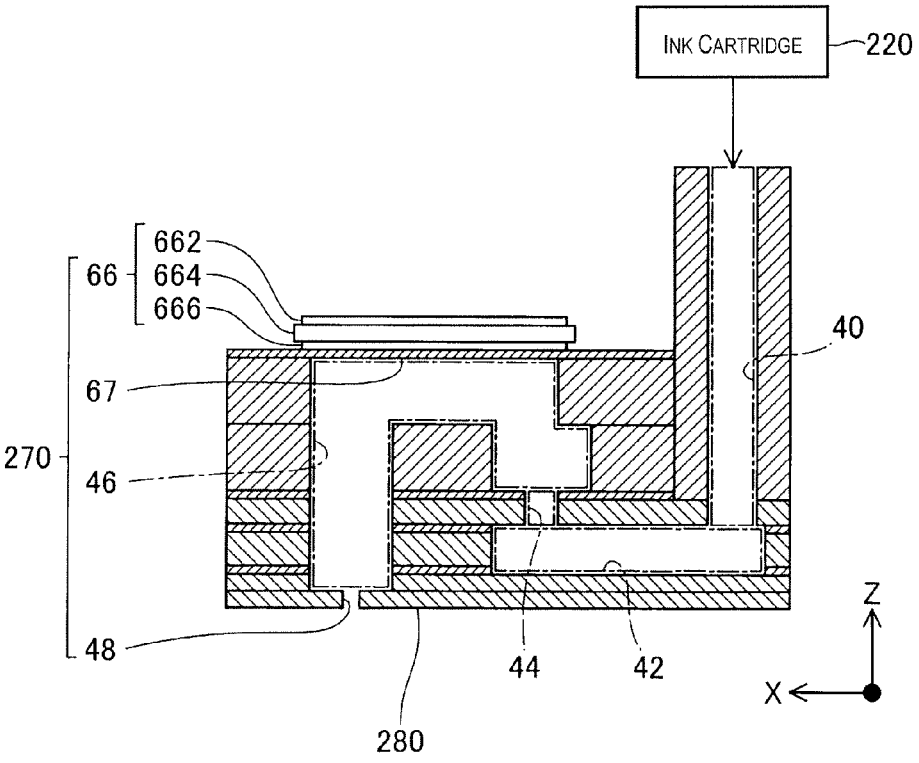
FIG. 3 is a descriptive diagram showing an ink ejecting mechanism in the head unit.

In the description of the present embodiment, the reference symbol "48" is employed in cases of referring generically to nozzles in the head unit 200, whereas the reference symbol "48*k*" is used in a case where black nozzles are identified, the reference symbol "48*c*" in a case where cyan nozzles are identified, the reference symbol "48*m*" in a case where magenta nozzles are identified, and the reference symbol "48*y*" in a case where yellow nozzles are identified, respectively. Further, in cases of identifying individual nozzles, a nozzle number is appended to the reference symbol. For example, as shown in FIG. 2, the reference symbol "48*y*(1)" is employed for the first yellow nozzle, the reference symbol "48*y*(2)" for the second yellow nozzle, the reference symbol "48*y*(3)" for the third yellow nozzle, . . . , the reference symbol "48*y*(n−1)" for the (n−1)th yellow nozzle, and the reference symbol "48*y*(n)" for the (n)th yellow nozzle FIG. 3 is a descriptive diagram showing an ink ejecting mechanism in the head unit 200. In FIG. 3, the head 280 is shown in cross section taken along the direction of gravity (Z axis direction). The ink ejecting mechanism of the head unit 200 is provided with feed channels 40, reservoirs 42, feed ports 44, cavities 46, nozzles 48, driving elements 66, and oscillator plates 67.

The feed channels 40 and the reservoirs 42 of the ink ejecting mechanism are furnished for each color of ink, and farm portions of flow channels through which the inks flow from the ink cartridges 220 to the nozzles 48. The inks supplied to the head unit 200 from the ink cartridges 220 through the feed channels 40 are held in the reservoirs 42.

The feed ports 44, the cavities 46, the driving elements 66, and the oscillator plates 67 in the ink ejecting mechanism are each furnished in corresponding fashion with the plurality of nozzles 48 formed in the head 280, and together with the nozzles 48 constitute ejectors 270. That is, the head unit 200 is provided with a plurality of ejectors 270 corresponding in number to the nozzles 48. Through driving of the driving elements 66, the ejectors 270 eject ink within the cavities 46 from the nozzles 48 which communicate with the cavities 46.

The feed ports 44 and the cavities 46 of the ejectors 270 form parts of flow channels for flow of ink from the ink cartridges 220 to the nozzles 48. The feed ports 44 are flow channels communicating between the reservoirs 42 and the cavities 46, and ink is supplied to the cavities 46 from the reservoirs 42 through the feed ports 44. The cavities 46 are flow channels communicating with the nozzles 48, have a flow channel cross section sufficiently greater in size than the feed ports 44 and the nozzles 48, and hold the ink prior to ejection.

The driving elements 66 of the ejectors 270 are furnished to the cavities 46 through the agency of the oscillator plates 67, with the oscillator plates 67 of the ejectors 270 forming part of the flow channel wall in the cavities 46. In the present embodiment, the driving elements 66 are unimorph piezoelectric actuators of a piezoelectric 664 stacked between two electrodes 662, 666 and furnished with oscillator plates 67 on the electrode 666 side thereof; in other embodiments, however, stacked piezoelectric actuators can be implemented as the driving elements 66. The driving elements 66 experience deflection in the direction of gravity (the Z axis direction) based on application of a drive signal, bringing about displacement of the oscillator plates 67. In so doing, the cavities 46 expand in capacity to draw in ink from the reservoirs 42, and thereafter the cavities 46 contract in capacity, making it possible for drops of ink to be ejected from the nozzles 48.

Returning to the description of FIG. 1, in the present embodiment, the printer 10 is furnished with a head wiper 330 and a head cap 340 by way of a maintenance mechanism for the head 280 of the head unit 200. The head wiper 330 of the printer 10 wipes the head 280, thereby removing ink deposited on the head 280. In a case where the nozzles 48 of the ejectors 270 have become clogged due to air bubbles or to thickened and deteriorated ink, the head cap 340 of the printer 10 attaches to the head 280 and suctions the degraded ink from the nozzles 48, thereby restoring the ejectors 270 to a state in which proper ink ejection is again possible.

Figure 4:
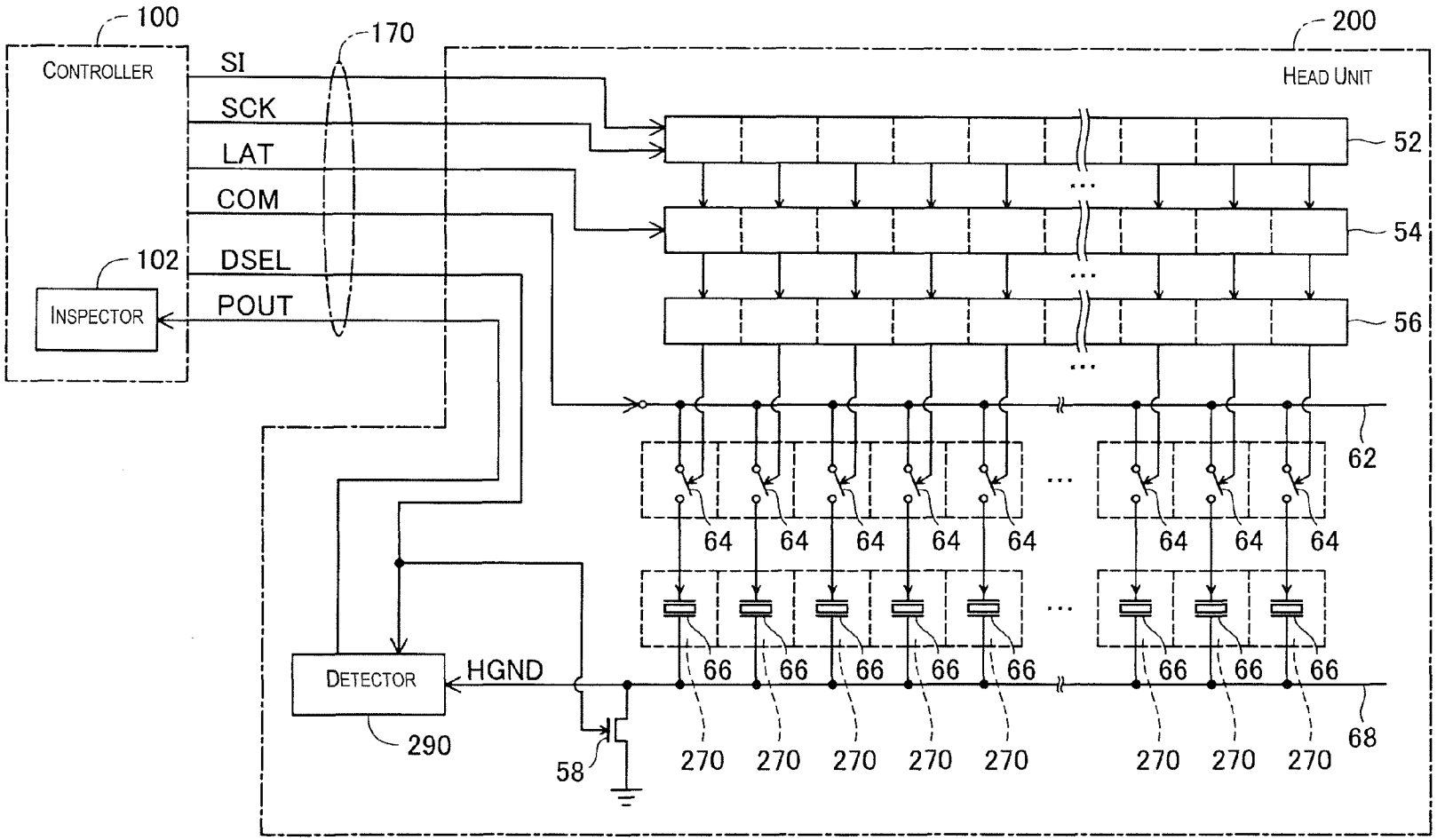
FIG. 4 is a descriptive diagram showing electrical configurations of the controller and the head unit.

FIG. 4 is a descriptive diagram showing electrical configurations of the controller 100 and the head unit 200. The controller 100 is provided with an inspector 102, while the head unit 200 is provided with a shift register 52, a latch circuit 54, a level shifter 56, a switch 58, common electrical paths 62, 68, a plurality of switches 64, and a detector 290.

The shift register 52 of the head unit 200 is a storage device for retaining instruction data instructing operations of the driving elements 66 in the plurality ejectors 270. Instruction data corresponding to each of the driving elements 66 is sequentially output from the controller 100 to a shift input signal SI in synchronization with a clock signal SCK; and based on the shift input signal SI and the clock signal SCK, the instruction data corresponding to each of the driving elements 66 is sequentially saved to the shift register 52. In the present embodiment, the instruction data corresponding to each of the driving elements 66 is 2-bit data showing either [0,0], [0,1], [1,0], or [1,1].

Based on latch signal LAT from the controller 100, the latch circuit 54 of the head unit 200 holds the instruction data of each of the driving elements 66 saved in the shift register 52, and outputs to the level shifter 56 logic signals in response to the instruction data. The latch signal LAT is output from the controller 100 at timing coincident with all of the instruction data of the driving elements 66 being saved in the shift register 52. In the present embodiment, the latch circuit 54 outputs a Lo level logic signal in response to instruction data of [0,0]; a Lo level followed by a Hi level logic signal in response to instruction data of [0,1]; a Hi level followed by a Lo level logic signal in response to instruction data of [1,0]; and a Hi level logic signal in response to instruction data of [1,1].

In response to the logic signals output from the latch circuit 54, the level shifter 56 of the head unit 200 outputs individually to the plurality of switches 64 connected to the driving elements 66 a voltage of a level whereby ON/OFF switching of the switch 64 is possible. In the present embodiment, in response to a Lo level logic signal from the latch circuit 54, the level shifter 56 outputs a voltage of a level for switching OFF the switch 64; or in response to a Hi level logic signal from the latch circuit 54, outputs a voltage of a level for switching ON the switch 64.

The plurality of switches 64 in the head unit 200 switch ON or OFF electrical connections between the common electrical path 62 and each of the driving elements 66. A drive signal COM for driving the driving element 66 is input from the controller 100 to the common electrical path 62 of the head unit 200. In the ON state with the driving element 66 electrically connected to the common electrical path 62 by the switch 64, the drive signal COM is applied to the electrode 662 side of the driving element 66, or in the OFF state with the driving element 66 electrically disconnected from the common electrical path 62 by the switch 64, no drive signal COM is applied to the electrode 662 side of the driving element 66. In the present embodiment, the switches 64 are analog switches relying on transmission gates.

The switch 58 of the head unit 200 connects to ground (earth) the common electrical path 68 which is electrically connected to the electrode 666 side of each driving element 66. In the present embodiment, during the interval that detector 290 detects an electrical signal HGND output from the common electrical path 68, the switch 58 electrically disconnects the common electrical path 68 from ground, on the basis of a detection-enable signal DSEL output from the controller 100. In so doing, based on a change in voltage between ground and the electrical signal HGND of the common electrical path 68, the detector 290 can effectively detect electromotive force applied to the common electrical path 68 from the driving elements 66.

The detector 290 of the head unit 200 detects an electrical signal SW in response to vibration of the ink inside the cavities 46 in the ejectors 270, which represents residual vibration remaining from driving of the driving elements 66. In the present embodiment, the driving elements 66 function as sensors for sensing residual vibration and outputting an electrical signal SW in response to residual vibration. An electrical signal SW output from each driving element 66 due to electromotive force associated with residual vibration is applied to the common electrical path 68. In so doing, by detecting the electrical signal HGND of the common electrical path 68, the detector 290 can detect electrical signals in response to residual vibration. In the present embodiment, based on the detection-enable signal DSEL output from the controller 100, the detector 290 detects the signal HGND of the common electrical path 68, and outputs to the controller 100 a detection signal POUT showing the detected result.

The inspector 102 of the controller 100 inspects the ejectors 270 on the basis of electrical signals detected by the detector 290 of the head unit 200. In the present embodiment, based on the detection signal POUT output from the detector 290 of the head unit 200, the inspector 102 inspects a state of the ejectors 270, namely, clogging of the nozzles 48 (thickening or entrainment of air bubbles in ink). The operation of the controller 100 is discussed in detail below.

Figure 5:
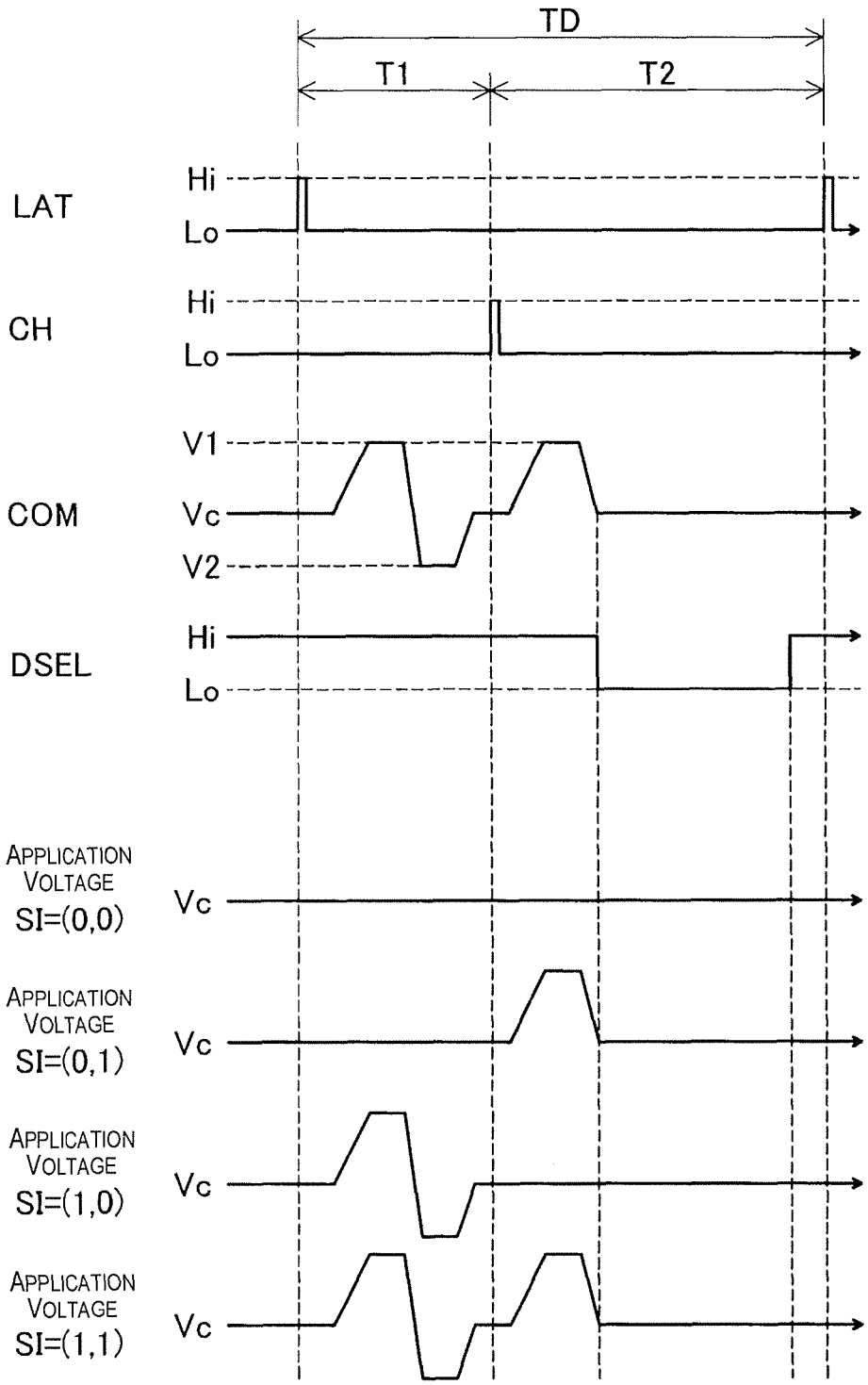
FIG. 5 is a descriptive diagram showing an example of various types of signals in the controller and the head unit.

FIG. 5 is a descriptive diagram showing an example of various types of signals in the controller 100 and the head unit 200. FIG. 5 illustrates, in order from the top, temporal changes of the latch signal LAT, a switching signal CH, the drive signal COM, and the detection-enable signal DSEL; below these are illustrated temporal changes of voltage applied to the driving elements 66 in response to instruction data of the shift input signal SI.

The latch signal LAT is a logic signal that rises in response to a drive cycle TD, and is input to the latch circuit 54 from the controller 100. The drive cycle TD corresponds to a time period for driving the driving elements 66 in the ejectors 270 and generating a single pixel on the printing medium 90.

The switching signal CH is a signal generated in the head unit 200 on the basis of the latch signal LAT, and is a logic signal that rises in response to elapse of a specified time following the rise of the latch signal LAT. During a first time period T1 from the rise of the latch signal LAT to the rise of the switching signal CH, the latch circuit 54 outputs a logic signal in response to the first bit of the 2-bit instruction data received from the shift register 52; and during a second time period T2 from the rise of the switching signal CH to the next rise of the latch signal LAT, outputs a logic signal in response to the second bit of the 2-bit instruction data.

The drive signal COM is a voltage signal output cyclically in synchronization with the drive cycle TD by being fed from the controller 100 to the driving elements 66 through the common electrical path 62 and the switches 64. In the first time period T1, the drive signal COM rises from a state of maintaining an intermediate voltage Vc to a voltage V1 which is higher than the intermediate voltage Vc, falls to a voltage V2 which is lower than the intermediate voltage Vc, then resumes the intermediate voltage Vc. In the subsequent second time period T2, the drive signal COM rises from the intermediate voltage Vc to the voltage V1 which is higher than the intermediate voltage Vc, then resumes a state of maintaining the intermediate voltage Vc. The drive signal COM in the first time period T1 is a signal of an application level for bringing about ejection of ink drops from the nozzles 48 of the ejectors 270. The drive signal COM in the second time period T2 is a signal of an application level for generating residual vibration, without bringing about ejection of ink drops from the nozzles 48.

The detection-enable signal DSEL is a logic signal which, in cases in which the ejectors 270 are to be inspected on the basis of residual vibration, falls during an interval from a timing coincident with the drive signal COM returning from the voltage V1 to the intermediate voltage Vc in the second time period T2 to a timing prior to completion of the second time period T2. Once the detection-enable signal DSEL falls, the switch 58 of the head unit 200 electrically disconnects the common electrical path 68 from ground, and the detector 290 of the head unit 200 detects the electrical signal HGND of the common electrical path 68.

In a case in which the instruction data of the shift input data SI is [0,0], the applied voltage applied to a driving element 66 assumes a state of maintaining the intermediate voltage Vc throughout the drive cycle TD. Therefore, no ink drop is ejected from the ejector 270 corresponding to that driving element 66, nor is residual vibration generated. Instruction data of [0,0] in the shift input data SI is established for ejectors 270 which are not to form pixels during printing, or for ejectors 270 not under inspection based on residual vibration.

In a case in which the instruction data of the shift input data SI is [0,1], the applied voltage applied to a driving element 66 assumes a state of maintaining the intermediate voltage Vc in the first time period T1, and thereafter rises to voltage V1 in the second time period T2. Therefore, in the ejector 270 corresponding to that driving element 66, residual vibration is generated, but no ink drop is ejected. Instruction data of [0,1] in the shift input data SI is established for ejectors 270 under inspection based on residual vibration, when carrying out inspection without forming pixels.

In a case in which the instruction data of the shift input data SI is [1,0], the applied voltage applied to a driving element 66 changes from voltage V1 to voltage V2 in the first time period T1, and thereafter assumes a state of maintaining the intermediate voltage Vc in the second time period T2. Therefore, in the ejector 270 corresponding to that driving element 66, an ink drop is ejected. Instruction data of [1,0] in the shift input data SI is established for ejectors 270 that are to form pixels during printing.

In a case in which the instruction data of the shift input data SI is [1,1], the applied voltage applied to a driving element 66 changes from voltage V1 to voltage V2 in the first time period T1, and thereafter changes to voltage V1 in the second time period T2. Therefore, in the ejector 270 corresponding to that driving element 66, while an ink drop is ejected, residual vibration suitable for inspection of the ejector 270 can be generated. Instruction data of [1,1] in the shift input data SI is established for ejectors 270 under inspection based on residual vibration, when carrying out inspection while forming pixels.

A2. Printer Operation

Figure 6:
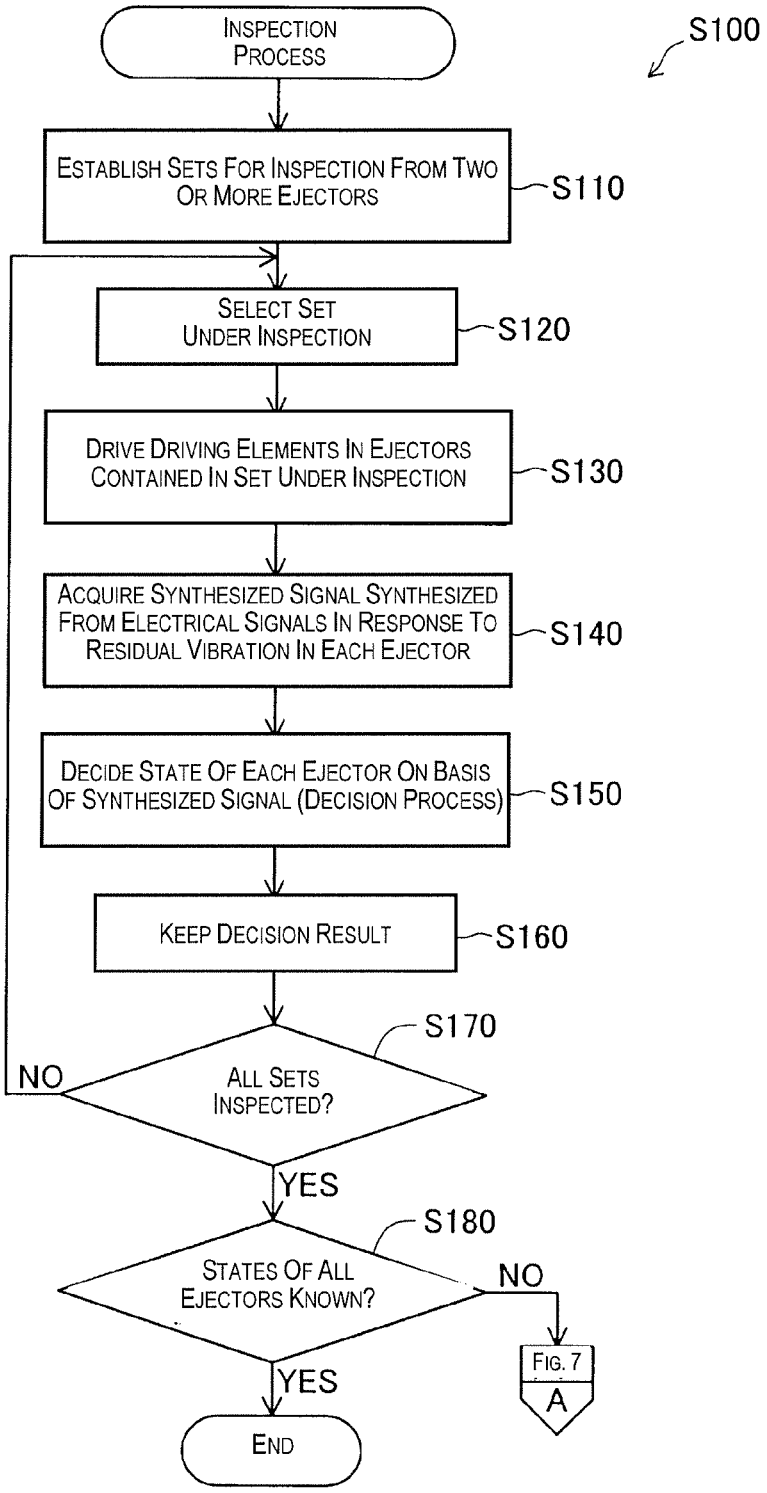
FIG. 6 is a flowchart showing an inspection process executed by the controller in the printer.
Figure 7:
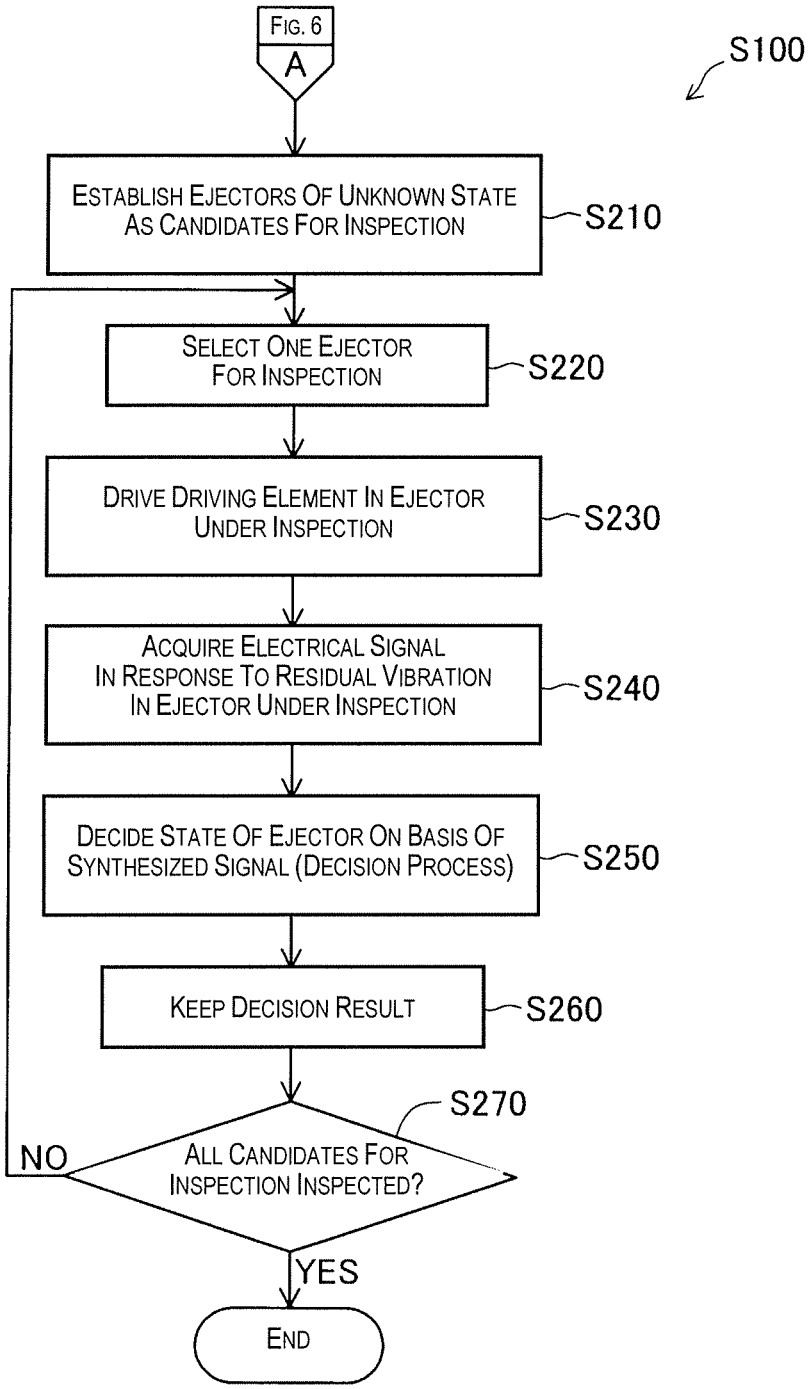
FIG. 7 is a flowchart showing an inspection process executed by the controller in the printer.

FIG. 6 and FIG. 7 are flowcharts showing an inspection process (Step S100) executed by the controller 100 in the printer 10. The inspection process (Step S100) is a process for inspecting a plurality of the ejectors 270 in the head unit 200 on the basis of residual vibration. In the present embodiment, the inspection process (Step S100) is realized through operation of the CPU of the controller 100 as the inspector 102 based on a computer program. In the present embodiment, the controller 100 starts the inspection process (Step S100) at a pre-established time, or on the basis of an instruction input by a user.

When the inspection process (Step S100) starts, the controller 100 establishes a set under inspection, which is composed of two or more ejectors 270 (Step S110). In the present embodiment, the controller 100 combines two ejectors 270, when establishing a set under inspection; however, in other embodiments, a number of ejectors 270 equal to two or greater can be combined when establishing sets under inspection.

In the present embodiment, the controller 100 establishes a set under inspection according to a positional relationship such that other ejectors 270 are disposed between the two ejectors 270 established as the set under inspection. Further, in the present embodiment, as the set under inspection, the controller 100 establishes two ejectors 270 that eject the same color of ink (same type of liquid). For example, as shown in FIG. 2, because the yellow nozzle 48*y*(1) neighbors the nozzle 48*y*(2) and the nozzle 48*y*(3), the controller 100 establishes an ejector 270 that corresponds to one nozzle 48*y* different from the nozzle 48*y*(2) and the nozzle 48*y*(3), from among the n number of nozzles 48*y* of the same yellow color, to be inspected in a paired manner with the ejector 270 that corresponds to the nozzle 48*y*(1).

In the present embodiment, the controller 100 establishes sets under inspection for all of the plurality of ejectors 270. For example, in a case where the number "n" of nozzles 48 of each color is an even number, "n/2" sets under inspection are established for each color; or in a case where the number "n" of nozzles 48 of each color is an odd number, "(n+1)/2" sets under inspection are established for each color by establishing sets under inspection with one of the n nozzles 48 overlapping.

Once the sets under inspection have been established (Step S110), the controller 100 selects one from among the plurality of sets under inspection (Step S120), and drives the driving elements 66 of the ejectors 270 included in that set under inspection (Step S130). In the present embodiment, because two ejectors 270 have been established in each single set under inspection, the controller 100 drives two ejectors 270 under inspection.

Specifically, the controller 100 establishes a [0,1] in the instruction data of the shift input signal SI corresponding to the two ejectors 270 under inspection, while establishing a [0,0] in the instruction data of the shift input signal SI corresponding to the other ejectors 270; and then outputs the shift input signals SI and a clock signal SCK, together with the latch signal LAT, the drive signal COM, and the detection-enable signal DSEL, to the head unit 200 as shown in FIG. 5. In so doing, electrical signals SW in response to residual vibration from the driving elements 66 in the two ejectors 270 under inspection are applied in common to the common electrical path 68. During this time, the electrical signal HGND of the common electrical path 68 detected by the detector 290 of the head unit 200 is a synthesized signal PW synthesized from the plurality of electrical signals SW in response to individual residual vibration in the two ejectors 270 under inspection, and the detector 290 outputs a detection signal POUT showing the synthesized signal PW, as the detection result to the controller 100.

Once the driving elements 66 under inspection have been driven (Step S130), the controller 100 acquires the synthesized signal PW through the detection signal POUT output by the detector 290 of the head unit 200 (Step S140), and executes a decision process (Step S150). In the decision process (Step S150), based on the synthesized signal PW detected by the detector 290 of the head unit 200, the controller 100 decides, in relation to the state of the ejectors 270 under inspection, whether there is clogging (entrainment of air bubbles and thickening) in the nozzles 48.

Figure 8:
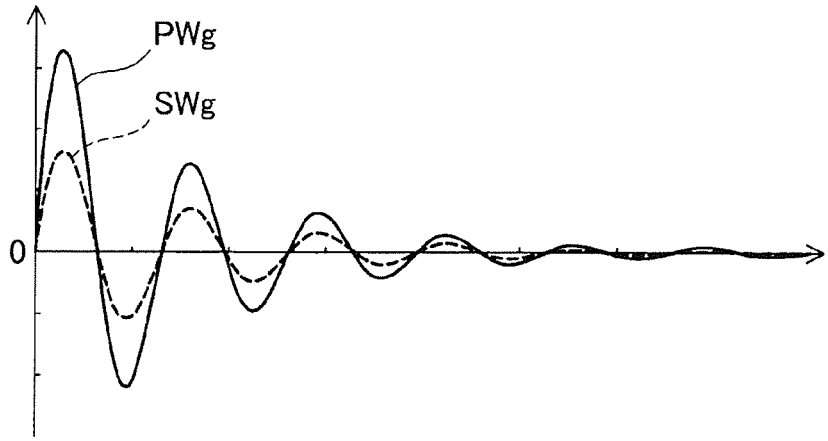
FIG. 8 is a descriptive diagram showing an example of an electrical signal SWg and a synthesized signal PWg, in an ink-ejectable state.

FIG. 8 is a descriptive diagram showing an example of an electrical signal SWg and a synthesized signal PWg, in an ink-ejectable state. In FIG. 8, the electrical signal SWg and the synthesized signal PWg are illustrated with voltage established on the vertical axis and time on the horizontal axis. The electrical signal SWg of FIG. 8 shows an electrical signal SW observed in response to residual vibration in a single ejector 270 in an ink-ejectable state, and the synthesized signal PWg of FIG. 8 shows a synthesized signal PW synthesized from two electrical signals SWg in an ink-ejectable state. As shown in FIG. 8, the waveform of the synthesized signal PWg is double the amplitude of the electrical signal SWg, but has a vibration cycle and damping time comparable to the electrical signal SWg.

Here, the following equation is obtained by calculating, for a volume velocity u, a step response observed when a pressure P is imparted to a simple-vibration calculation model which assumes the vibrating plate 67 of an ejector 270.

[Eq. 1]

$$u = \frac{P}{\omega \cdot m} e^{-\omega t} \cdot \sin\omega t (\mathrm{m}^3/\mathrm{s}) \tag{1a}$$

$$\omega = \sqrt{\frac{1}{m \cdot c} - \alpha^2} \tag{1b}$$

$$\alpha = \frac{r}{2m} \tag{1c}$$

In the aforedescribed Equation 1, flow channel resistance r is dependent upon flow channel shape of the feed ports 44, the cavities 46, the nozzles 48, etc., and upon the viscosity of ink in these flow channels; inertance m is dependent upon the mass of the ink within flow channels such as the feed ports 44, the cavities 46, the nozzles 48, etc.; and compliance c is dependent upon elasticity of the vibrating plate 67.

Figure 9:
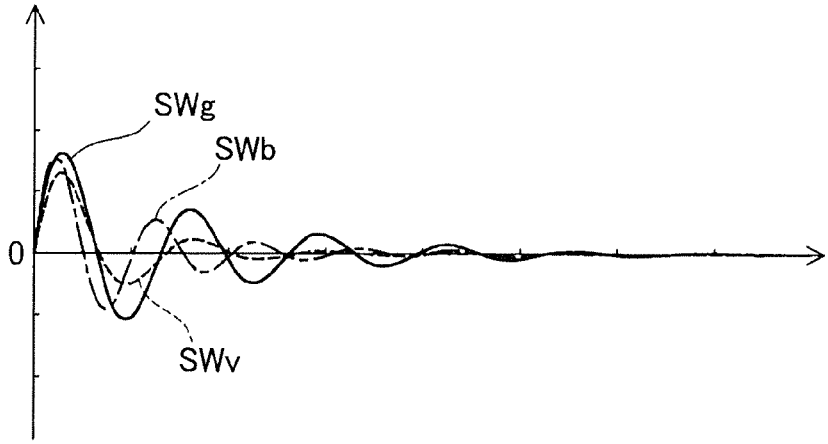
FIG. 9 is a descriptive diagram showing an example of change in electrical signals SW observed in response to residual vibration.

FIG. 9 is a descriptive diagram showing an example of change in electrical signals SW observed in response to residual vibration. In FIG. 9, electrical signals SWg, SWb, SWv are shown illustrated with voltage established on the vertical axis and time on the horizontal axis. As in FIG. 8, the electrical signal SWg of FIG. 9 shows an electrical signal SW in an ink-ejectable state.

The electrical signal SWb of FIG. 9 shows an electrical signal SW observed in response to residual vibration in a single ejector 270 in a state where ink cannot be ejected owing to generation of an air bubble in the ink inside a cavity 46. Generation of an air bubble inside a cavity 46 means less ink inside the cavity 46, and therefore inertance m is predominantly reduced. As shown by the previously discussed Equation 1, when inertance m is reduced, angular velocity to increases. As a result, as shown in FIG. 9, the vibration cycle of the electrical signal SWb is shorter than that of the electrical signal SWg. Specifically, the vibration frequency of the electrical signal SWb is higher than that of the electrical signal SWg.

The electrical signal SWv of FIG. 9 shows an electrical signal SW observed in response to residual vibration in a single ejector 270 in a state where ink cannot be ejected owing to thickening of the ink inside a cavity 46. Thickening of the ink inside a cavity 46 increases the flow passage resistance r, and therefore as shown in the previously discussed Equation 1 and in FIG. 9, the amount of damping of the electrical signal SWv is greater than that of the electrical signal SWg. Specifically, the damping time of the electrical signal SWv is shorter than that of the electrical signal SWg.

Figure 10:
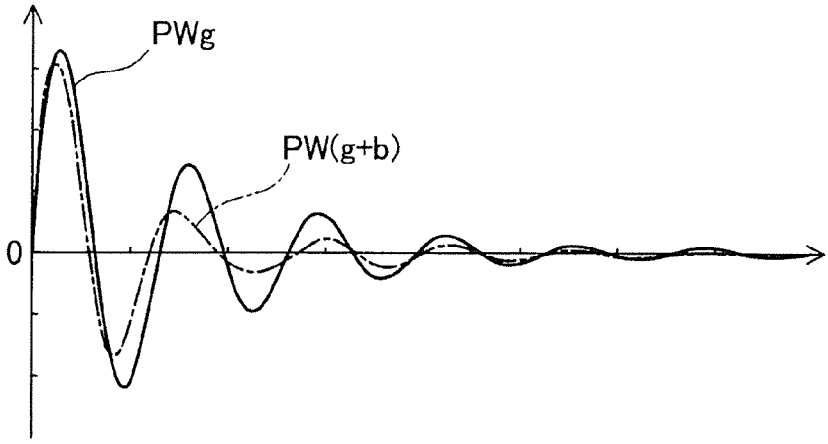
FIG. 10 is a descriptive diagram showing a first example of change of a synthesized signal PW synthesize from two electrical signals SW.
Figure 11:
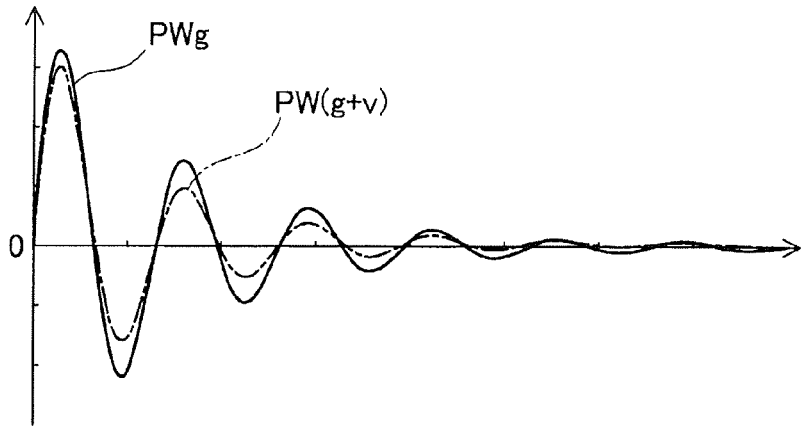
FIG. 11 is a descriptive diagram showing a second example of change of a synthesized signal PW synthesized from two electrical signals SW.
Figure 12:
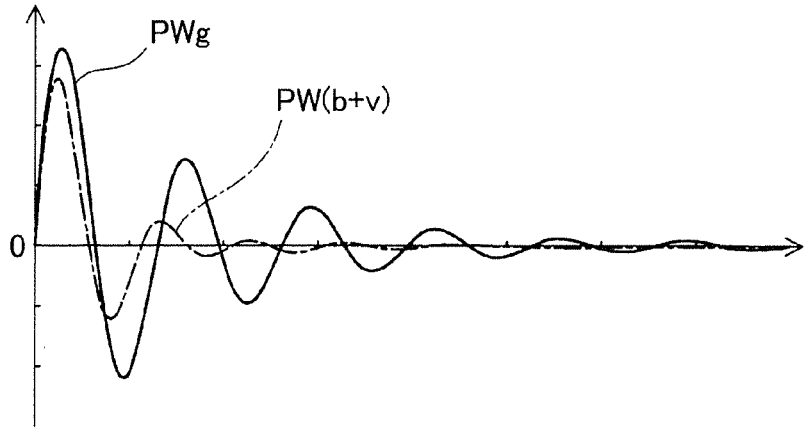
FIG. 12 is a descriptive diagram showing a third example of change of a synthesized signal PW synthesized from two electrical signals SW.

FIGS. 10, 11, and 12 are descriptive diagrams showing examples of change of a synthesized signal PW synthesized from two electrical signals SW. In FIG. 10, a synthesized signal PWg and a synthesized signal PW(g+b) are illustrated with voltage established on the vertical axis and time on the horizontal axis. In FIG. 11, a synthesized signal PWg and a synthesized signal PW(g+v) are illustrated with voltage established on the vertical axis and time on the horizontal axis. In FIG. 12, a synthesized signal PWg and a synthesized signal PW(b+v) are illustrated with voltage established on the vertical axis and time on the horizontal axis. As in FIG. 8, the synthesized signals PWg of FIGS. 10, 11, and 12 are synthesized signals PW synthesized from two electrical signals SWg in an ink-ejectable state.

The synthesized signal PW(g+b) of FIG. 10 shows a synthesized signal PW synthesized from an electrical signal SWg observed in an ink-ejectable state, and an electrical signal SWb observed in a state in which ink cannot be ejected owing to generation of an air bubble in the ink inside a cavity 46. As described in FIG. 9, the electrical signal SWb observed in a state in which an air bubble has been generated in the ink has a shorter vibration cycle, and therefore as shown in FIG. 10, the synthesized signal PW(g+b) has a shorter vibration cycle is shorter and a greater amount of damping, as compared with the synthesized signal PWg.

The synthesized signal PW(g+v) of FIG. 11 shows a synthesized signal PW synthesized from an electrical signal SWg observed in an ink-ejectable state, and an electrical signal SWv observed in a state in which ink cannot be ejected owing to thickening of ink inside a cavity 46. As described in FIG. 9, the electrical signal SWv observed in a state of thickening of the ink has a greater amount of damping, and therefore as shown in FIG. 11, the synthesized signal PW(g+v) has an identical vibration cycle with the synthesized signal PWg, but a greater amount of damping.

The synthesized signal PW(b+v) of FIG. 12 shows a synthesized signal PW synthesized from an electrical signal SWb observed in a state in which ink cannot be ejected owing to generation of an air bubble in the ink inside a cavity 46, and an electrical signal SWv observed in a state in which ink cannot be ejected owing to thickening of ink inside a cavity 46. As described in FIG. 9, the electrical signal SWb has a shorter vibration cycle, and the electrical signal SWv has a greater amount of damping, and therefore as shown in FIG. 12, the synthesized signal PW(b+v) has a shorter vibration cycle and a significantly greater amount of damping, as compared with the synthesized signal PWg.

Returning to the description of FIG. 6, in the present embodiment, in the decision process (Step S150) the controller 100 compares a synthesized signal PWg serving as a benchmark established when shipped from the factory with the synthesized signal PW detected by the detector 290, and in cases in which disparity of the vibration cycle and the amount of damping of the two are within range of established threshold values, decides that the two ejectors 270 under inspection are in an ink-ejectable state (a state without clogging). In the present embodiment, as shown in FIGS. 10, 11, and 12, in cases in which the vibration cycle and the amount of damping of the synthesized signal PW detected by the detector 290 exceed established threshold values, because it cannot be identified which of the ejectors 270 is in a clogged state, the controller 100 decides that the two ejectors 270 under inspection are in an unknown state.

After the decision process (Step S150) the controller 100 keeps the decision result of the decision process (Step S150) (Step S160). Thereafter, the controller 100 repeatedly executes the decision process (Step S150) until all of the sets under inspection have been inspected (Step S170: NO).

Once inspection of all of the sets under inspection is finished (Step S170: YES), in cases in which the states of all of the ejectors 270 are known (Step S180: YES), specifically, in cases in which all of the ejectors 270 have been decided to be in an ink-ejectable state (a state without clogging), the controller 100 completes the inspection process (Step S100).

On the other hand, if it is not the case that the states of all of the ejectors 270 are known (Step S180: NO), the controller 100 establishes those in an unknown state (Step S210) as the ejectors 270 under inspection.

Once the ejectors 270 under inspection have been established, the controller 100 selects one ejector 270 from among those under inspection (Step S220), and drives the driving element 66 in that ejector 270 (Step S230).

Specifically, a [0,1] is established in the instruction data of the shift input signal SI corresponding to one of the ejectors 270 under inspection, while establishing a [0,0] in the instruction data of the shift input signal SI corresponding to the other ejector 270; and as shown in FIG. 5, the shift input signals SI and a clock signal SCK are output to the head unit 200 together with the latch signal LAT, the drive signal COM, and the detection-enable signal DSEL. In so doing, an electrical signal SW in response to residual vibration is applied to the common electrical path 68 from the driving element 66 in the ejector 270 under inspection. During this time, the electrical signal HGND of the common electrical path 68 detected by the detector 290 of the head unit 200 is an electrical signal SW in response to residual vibration in the ejector 270 under inspection, and the detector 290 outputs a detection signal POUT showing the electrical signal SW, as the detection result to the controller 100.

Once the driving element 66 under inspection has been driven (Step S230), the controller 100 acquires the electrical signal SW through the detection signal POUT output by the detector 290 of the head unit 200 (Step S240), and executes a decision process (Step S250). In the decision process (Step S250), on the basis of the electrical signal SW detected by the detector 290 of the head unit 200, the controller 100 decides by way of the state of the ejector 270 under inspection whether there is clogging (entrainment of air bubbles and thickening) in the nozzle 48.

In the present embodiment, in the decision process (Step S250) the controller 100 compares an electrical signal SWg serving as a benchmark established when shipped from the factory with the electrical signal SW detected by the detector 290, and in cases in which disparity of the vibration cycle and the amount of damping of the two are within range of established threshold values, decides that the ejector 270 under inspection is in an ink-ejectable state (a state without clogging). In the present embodiment, in a case in which disparity of the vibration cycle of the electrical signal SW detected by the detector 290 exceeds the established threshold value as shown by the electrical signal SWb of FIG. 9, the controller 100 decides upon a state in which ink cannot be ejected owing to generation of an air bubble in the ink (a state of clogging due to an air bubble); or a case in which disparity of damping exceeds the established threshold value as shown by the electrical signal SWv of FIG. 9, decides upon a state in which ink cannot be ejected owing to thickening of the ink (state of clogging due to thickening).

Subsequent to the decision process (Step S250), the controller 100 keeps the decision result of the decision process (Step S250) (Step S260). Thereafter, the controller 100 repeatedly executes the decision process (Step S250) until all of the ejectors 270 under inspection have been inspected (Step S270: NO). Once inspection of all of the ejectors 270 under inspection is finished (Step S270: YES), the controller 100 completes the inspection process (Step S100). In the present embodiment, in response to the inspection results of the process (Step S100), the controller 100, employing the head cap 340, executes a maintenance process for the head unit 200.

A3. Effect

According to the printer 10 of the aforedescribed first embodiment, because two ejectors 270 are inspected collectively on the basis of the synthesized signal PW, the speed of the process needed for inspection can be improved, as compared with the case where the ejectors 270 are inspected individually. As a result, process efficiency during inspection of the ejectors 270 on the basis of residual vibration can be improved. Also, even if the signal level of an individual electrical signal SW is low, because the synthesized signal PW employed is synthesized from two electrical signals SW and has an amplified signal level, inspection can be carried out easily.

Also, because electrical signals SW in response to residual vibration output by the driving elements 66 are applied in common to the common electrical path 68, the synthesized signal PW can be easily detected by the detector 290 of the head unit 200.

Also, in cases in which the state of an ejector 270 cannot be identified in the decision process (Step S150) on the basis of the synthesized signal PW (Step S180: NO), the decision process (Step S250) is carried out on the basis of the electrical signal SW, and therefore with regard to ejectors 270 whose state cannot be identified from the synthesized signal PW, the state thereof can be inspected and identified individually on the basis of the electrical signal SW in response to residual vibration in each of the ejectors 270.

Also, because sets under inspection are established such that other ejectors 270 are disposed between the two ejectors 270 established as a set under inspection (Step S110), the likelihood that ejectors 270 constituting a set will be mutually affected by residual vibration via the reservoir 42 can be minimized.

Also, because two ejectors 270 that eject the same color of ink are established as the set under inspection (Step S110), a complex algorithm for analyzing the synthesized signal PW can be avoided, as compared with cases in which two ejectors 270 that eject respectively different colors of ink are established as the set under inspection, due to the fact that different types of ink have respectively different residual vibration characteristics.

B. Second Embodiment

Figure 13:
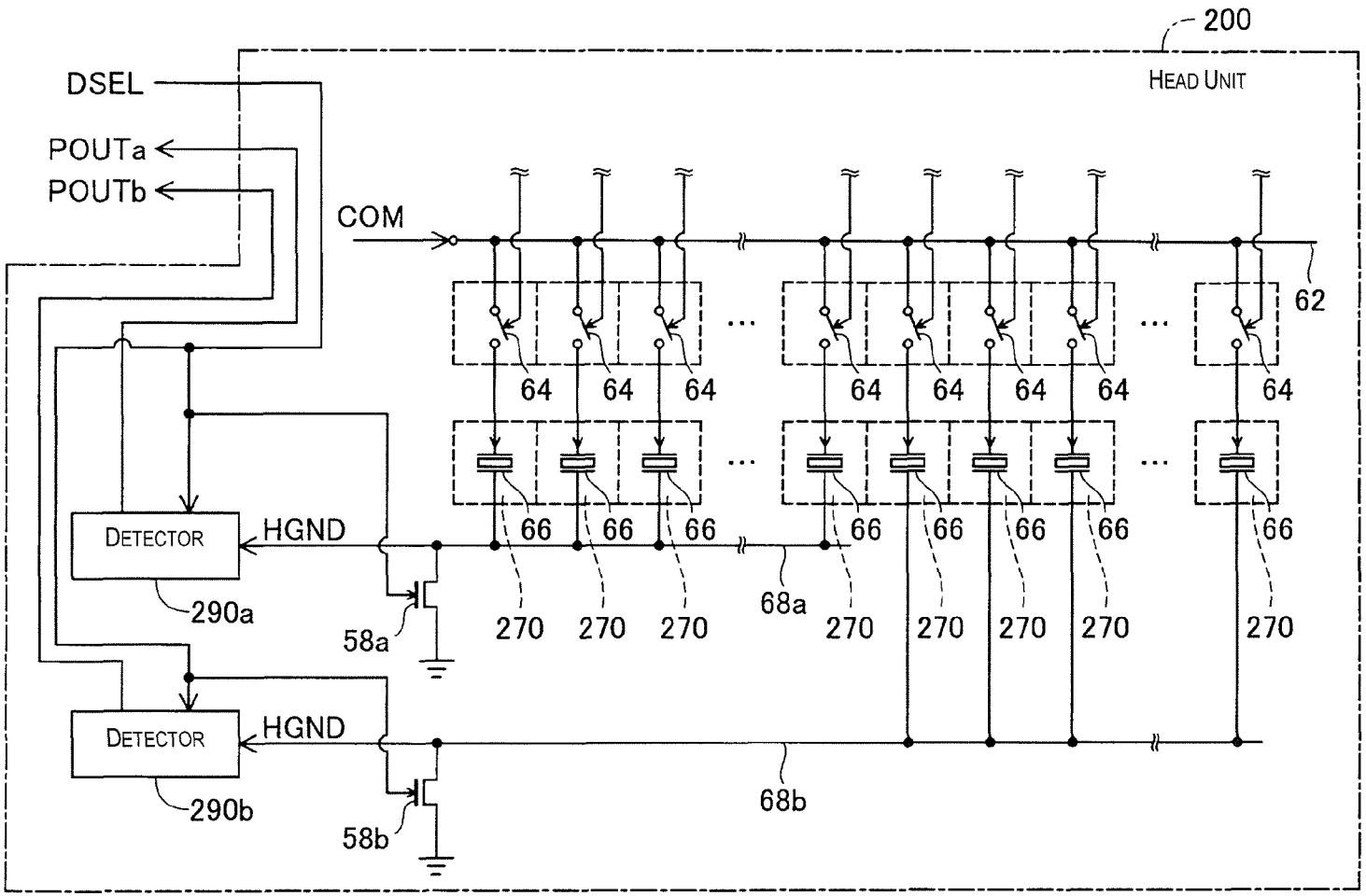
FIG. 13 is a descriptive diagram showing the electrical configuration of the head unit 200 in a second embodiment.

FIG. 13 is a descriptive diagram showing the electrical configuration of the head unit 200 in a second embodiment. The printer 10 of the second embodiment is similar to that of the first embodiment, except that the configuration of the head unit 200 differs. In place of the switch 58, the common electrical path 68, and the detector 290 in the first embodiment, the head unit 200 of the second embodiment is provided with two switches 58*a*, 58*b*, two common electrical paths 68*a*, 68*b*, and two detectors 290*a*, 290*b*, but in other respects is similar to the first embodiment.

In the second embodiment, half of the plurality of driving elements 66 are electrically connected at the electrode 666 side thereof to the common electrical path 68*a*, while the remaining driving elements 66 are electrically connected at the electrode 666 side thereof to the common electrical path 68*b*. The switch 58*a* connects the common electrical path 68*a* to ground, while the switch 58*b* connects the common electrical path 68*b* to ground. The switches 58*a*, 58*b* of the second embodiment electrically disconnect the common electrical paths 68*a*, 68*b* individually from ground on the basis of a detection-enable signal DSEL output from the controller 100.

The detector 290*a* of the second embodiment detects an electrical signal HGND from the common electrical path 68*a* on the basis of detection-enable signal DSEL output from the controller 100, and outputs a detection signal POUT showing the detection result to the controller 100. The detector 290*b* of the second embodiment detects an electrical signal HGND from the common electrical path 68*b* on the basis of detection-enable signal DSEL output from the controller 100, and outputs a detection signal POUT showing the detection result to the controller 100.

According to the printer 10 of the aforedescribed second embodiment, like the first embodiment, because the two ejectors 270 are inspected collectively on the basis of the synthesized signal PW, the speed of the process needed for inspection can be improved, as compared with the case where the ejectors 270 are inspected individually. Additionally, because synthesized signals PW and electrical signals SW in response to residual vibration can be detected in parallel by the two detectors 290*a*, 290*b*, the speed of the process needed for inspection can be improved further.

C. Third Embodiment

Figure 14:
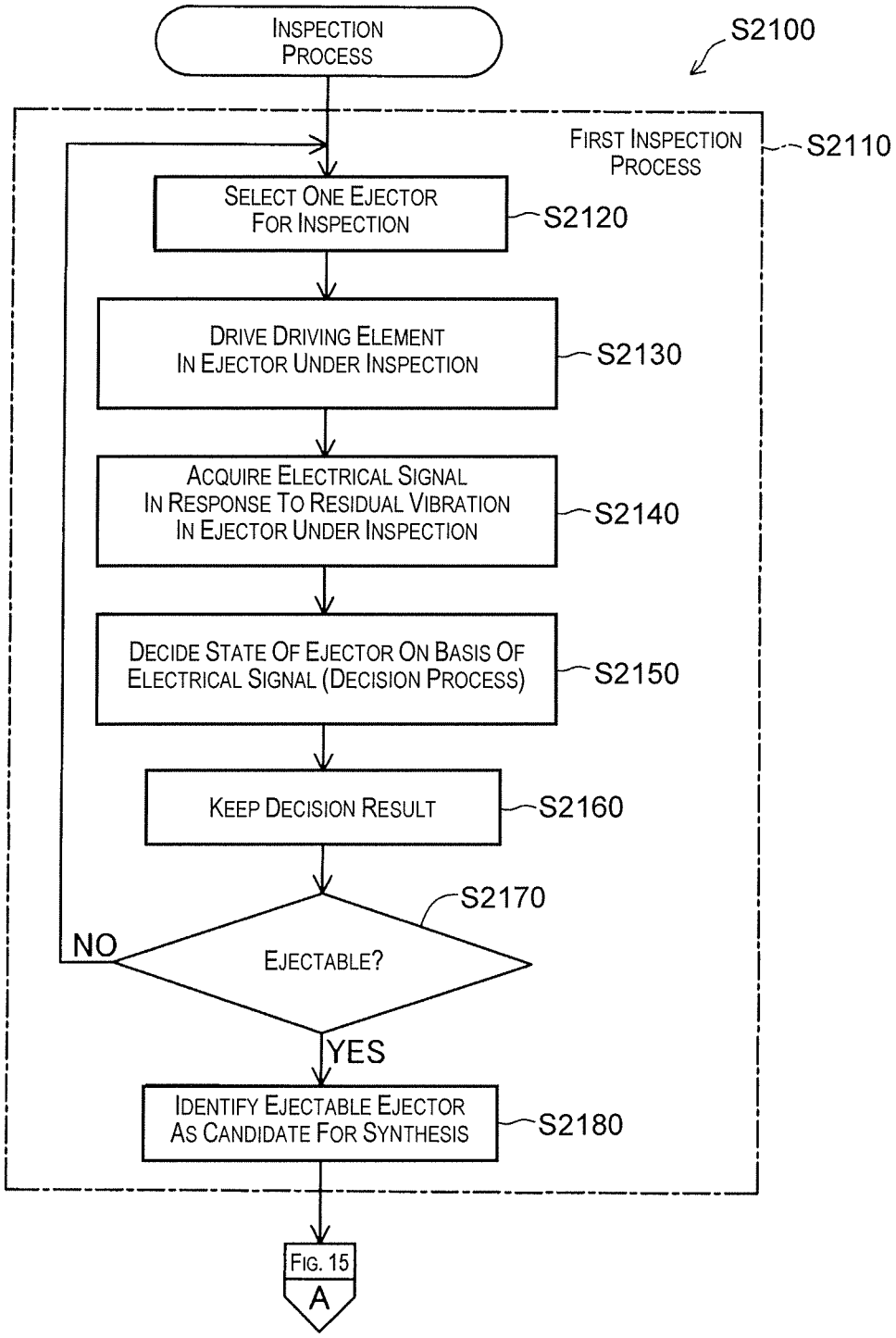
FIG. 14 is a flowchart showing an inspection process executed by the controller in the printer of a third embodiment.
Figure 15:
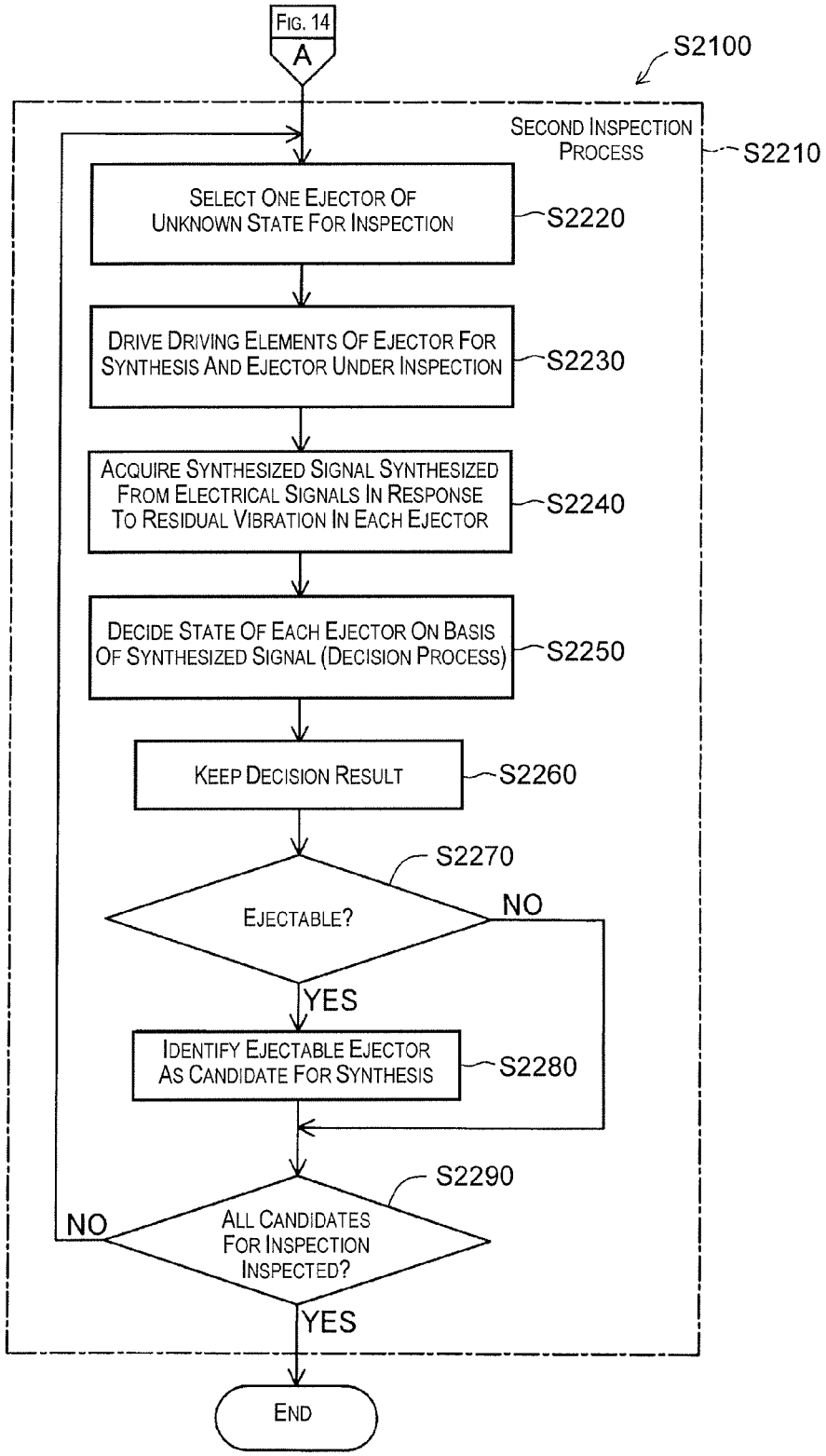
FIG. 15 is a flowchart showing an inspection process executed by the controller in the printer of a third embodiment.

FIGS. 14 and 15 are flowcharts showing an inspection process (Step S2100) executed by the controller 100 in the printer 10 of a third embodiment. The printer 10 of the third embodiment is similar to that of the first embodiment, except that the operation in the printer differs.

In the third embodiment, the inspection process (Step S2100) is a process of inspection based on residual vibration of the plurality of ejectors 270 in the head unit 200. Specifically, the controller 100 inspects the state of ejectors 270 under inspection, on the basis of a synthesized signal PW synthesized from an electrical signal SWg of residual vibration in an ejector 270 in a liquid-ejectable state (state without clogging), and an electrical signal SW of residual vibration in an ejector 270 under investigation.

In the present embodiment, the controller 100 executes the inspection process (Step S2100) on every ejector 270 ejecting ink of the same color (liquid of the same type). For example, after executing the inspection process (Step S2100) on the black ejectors 270, the controller 100 then executes the inspection process (Step S2100) in order on the cyan ejectors 270, the magenta ejectors 270, and the yellow ejectors 270, respectively.

In the present embodiment, the inspection process (Step S2100) is realized through operation of the CPU of the controller 100 as the inspector 102 on the basis of a computer program. In the present embodiment, the controller 100 starts the inspection process (Step S2100) at pre-established time, or on the basis of an instruction input by a user.

When the inspection process (Step S2100) starts, the controller 100 executes a first inspection process (Step S2110). The first inspection process (Step S2110) is a process in which, prior to inspection based on a synthesized signal PW, a single ejector 270 in an ink-ejectable state (state without clogging) is identified from among the plurality of ejecting sections 270.

In the first inspection process (Step S2110), the controller 100 selects one ejector 270 for investigation from among the plurality of ejectors 270 (Step S2120), and drives the driving element 66 in the ejector 270 (Step S2130).

Specifically, a [0,1] is established in the instruction data of the shift input signal SI corresponding to the one ejector 270 under inspection, while establishing a [0,0] in the instruction data of the shift input signal SI corresponding to the other ejectors 270; and the shift input signals SI and a clock signal SCK, together with the latch signal LAT, the drive signal COM, and the detection-enable signal DSEL, are output to the head unit 200 as shown in FIG. 5 in the first embodiment. In so doing, an electrical signal SW in response to residual vibration is applied to the common electrical path 68 from the driving element 66 in the ejector 270 under inspection. During this time, the electrical signal HGND of the common electrical path 68 detected by the detector 290 of the head unit 200 is an electrical signal SW in response to residual vibration in the ejector 270 under inspection, and the detector 290 outputs a detection signal POUT showing the electrical signal SW, as the detection result to the controller 100.

After driving of the driving element 66 under inspection (Step S2130), the controller 100 acquires the electrical signal SW through the detection signal POUT output by the detector 290 of the head unit 200 (Step S2140), and executes a decision process (Step S2150). In the decision process (Step S2150), based on the electrical signal SW detected by the detector 290 of the head unit 200, the controller 100 decides by way of the state of the ejector 270 under inspection whether there is clogging (entrainment of air bubbles and thickening) in the nozzle 48.

In the present embodiment, in the decision process (Step S2150) the controller 100 compares an electrical signal SWg serving as a benchmark established when shipped from the factory with the electrical signal SW detected by the detector 290, and in cases in which disparity of the vibration cycle and the amount of damping of the two are within range of established threshold values, decides that the ejector 270 under inspection is in an ink-ejectable state (a state without clogging). In the present embodiment, in a case in which disparity of the vibration cycle of the electrical signal SW detected by the detector 290 exceeds the established threshold value as shown by the electrical signal SWb of FIG. 9 in the first embodiment, the controller 100 decides upon a state in which ink cannot be ejected owing to generation of an air bubble in the ink (a state of clogging due to an air bubble); or a case in which disparity of damping exceeds the established threshold value as shown by the electrical signal SWv of FIG. 9, decides upon a state in which ink cannot be ejected owing to thickening of the ink (state of clogging due to thickening).

Subsequent to the decision process (Step S2150), the controller 100 keeps the decision result of the decision process (Step S2150) (Step S2160). Thereafter, the controller 100 repeatedly executes the decision process (Step S2150) until the ejector 270 under inspection in the decision process (Step S2150) is decided to be in an ink-ejectable state (Step S2170: NO). Once the ejector 270 under inspection in the decision process (Step S2150) is decided to be in an ink-ejectable state (Step S2170: YES), the controller 100 identifies the ejector 270 in question as being utilizable as a candidate for synthesis for the purpose of inspection based on a synthesized signal PW (Step S2180).

After the ink-ejectable ejector 270 has been as a candidate for synthesis (Step S2180) and the first inspection process (Step S2110) has finished, the controller 100 executes a second inspection process (Step S2210). The second inspection process (Step S2210) is a process for inspecting the ejectors 270 on the basis of a synthesized signal PW.

In the second inspection process (Step S2210), the controller 100 selects from among the plurality of ejectors 270 for inspection a single ejector 270 whose state is unknown (Step S2220).

In the present embodiment, the controller 100 selects candidates for inspection according to a positional relationship whereby another ejector 270 is disposed between an ejector 270 for synthesis and an ejector 270 under inspection. Further, in the present embodiment, as candidates for inspection, the controller 100 selects ejectors 270 that eject the same color of ink as the ejectors 270 for synthesis, in order that the inspection process (Step S2100) can be executed for every ejector 270 that ejects the same color of ink (same type of liquid). For example, as shown in FIG. 2 of the first embodiment, because the yellow nozzle 48*y*(1) neighbors the nozzle 48*y*(2) and the nozzle 48*y*(3), in a case in which the nozzle 48*y*(1) has been identified for synthesis, the controller 100 selects for inspection an ejector 270 that corresponds to one nozzle 48*y* different from the nozzle 48*y*(2) and the nozzle 48*y*(3), from among the n number of nozzles 48*y* of the same yellow color.

Once a selection for inspection has been made (Step S2220), the controller 100 respectively drives the driving element 66 in the first ejector 270 that was identified for synthesis, and the driving element 66 in the second ejector 270 that was identified for inspection (Step S2230).

Specifically, the controller 100 establishes a [0,1] in the instruction data of the shift input signal SI corresponding to the ejectors 270 which are candidates synthesis and for inspection, while establishing a [0,0] in the instruction data of the shift input signal SI corresponding to the other ejectors 270; and then outputs the shift input signals SI and a clock signal SCK, together with the latch signal LAT, the drive signal COM, and the detection-enable signal DSEL, to the head unit 200 as shown in FIG. 5 in the first embodiment. In so doing, electrical signals SW in response to residual vibration from the driving elements 66 in the ejectors 270 for synthesis and for inspection are applied in common to the common electrical path 68. During this time, the electrical signal HGND of the common electrical path 68 detected by the detector 290 of the head unit 200 is a synthesized signal PW synthesized from the electrical signal SWg of residual vibration in the ejector 270 for synthesis, which is in an ink-ejectable state, and the electrical signal SW of residual vibration in the ejector 270 under inspection, and the detector 290 outputs a detection signal POUT showing the synthesized signal PW, as the detection result to the controller 100.

Once the driving element 66 for synthesis and that under inspection have been driven (Step S2230), the controller 100 acquires the synthesized signal PW through the detection signal POUT output by the detector 290 of the head unit 200 (Step S2240), and executes a decision process (Step S2250). In the decision process (Step S2250), based on the synthesized signal PW detected by the detector 290 of the head unit 200, the controller 100 decides, in relation to the state of the ejector 270 under inspection, whether there is clogging (entrainment of air bubbles and thickening) in the nozzle 48.

In the decision process (Step S2250) of the present embodiment, the controller 100 compares a synthesized signal PWg serving as a benchmark established when shipped from the factory with the synthesized signal PW detected by the detector 290, and in cases in which disparity of the vibration cycle and the amount of damping of the two is within range of established threshold values, decides that the ejector 270 under inspection is in an ink-ejectable state (a state without clogging). In the present embodiment, in a case in which disparity of the vibration cycle of the synthesized signal PW detected by the detector 290 exceeds an established threshold value as shown by the electrical signal PW(g+b) of FIG. 10 in the first embodiment, the controller 100 decides upon a state in which ink cannot be ejected due to owing to generation of an air bubble in the ink (a state of clogging by an air bubble); or in a case in which disparity of damping exceeds an established threshold value as shown by the electrical signal PW(g+v) of FIG. 11 in the first embodiment, decides upon a state in which ink cannot be ejected due to owing to thickening of the ink (a state of clogging due to thickening).

Subsequent to the decision process (Step S2250), the controller 100 keeps the decision result of the decision process (Step S2250) (Step S2260). Thereafter, in a case in which the ejector 270 under inspection has been decided in the decision process (Step S2250) to be in the ink-ejectable state (Step S2270: YES), the controller 100 identifies the ejector 270 under inspection (Step S2280) as a new candidate for synthesis; or in a case in which a clogged state was decided upon, does not update the ejector 270 for synthesis (Step S2270: NO).

Thereafter, the controller 100 repeatedly executes the decision process (Step S2250) until all of the ejectors 270 under inspection have been inspected (Step S2290: NO). Once inspection of all of the ejectors 270 under inspection is finished (Step S2290: YES), the controller 100 completes the inspection process (Step S2100) concomitantly with completion of the second inspection process (Step S2210). In the present embodiment, in response to the detection results of the inspection process (Step S2100), the controller 100 executes a maintenance process of the head unit 200, employing the head cap 340.

C. Effects

According to the printer 10 of the aforedescribed third embodiment, because the synthesized signal PW employed in the decision process (Step S2250) in the second inspection process (Step S2210) is a signal that has been synthesized with the electrical signal SWg of residual vibration showing an ink-ejectable state, thereby amplifying the signal level thereof to one higher than the electrical signal SW of residual vibration under inspection, erroneous decision during inspection can be minimized.

Also, in the second inspection process (Step S2210) for inspecting the ejectors 270 on the basis of the synthesized signal PW, an ejector 270 decided to be in an ink-ejectable state is identified as a new candidate for synthesis, and therefore the load associated with driving in the plurality of ejectors 270 can be balanced.

Also, in the second inspection process (Step S2210), a candidate for inspection (Step S2220) is selected according to a positional relationship whereby another ejector 270 is disposed between the ejector 270 for synthesis and the ejector 270 under inspection, and therefore the likelihood of residual vibration in the ejector 270 for synthesis and residual vibration in the ejector 270 under inspection affecting one another through the reservoir 42 can be minimized.

Also, because the inspection process (Step S2100) is executed for every ejector 270 that ejects the same color of ink, as compared with cases in which two ejectors 270 that eject respectively different colors of ink are established as candidates for synthesis and for inspection, there can be avoided a complex algorithm for analyzing the synthesized signal PW due to the fact that the different types of ink have respectively different residual vibration characteristics.

D. Other Embodiments

While certain preferred embodiments of the invention have been described above, the invention is not limited to these embodiments, and can be carried out in various other modes without departing from the scope and spirit of the invention.

For example, in the preceding embodiments, driving elements 66 are utilized as sensors for sensing residual vibration in the ejectors 270; however, as another embodiment, dedicated sensors for sensing residual vibration can be implemented separately from the driving elements 66.

In the preceding embodiments, the inspection process (Steps S100, S2100) is carried out by driving the driving elements 66 at an application level to generate residual vibration without ejecting ink drops; however, as another embodiment, the inspection process (Steps S100, S2100) can be carried out by driving the driving elements 66 at an application level causing ink drops to be ejected.

Also, in the preceding embodiments, the inspection process (Steps S100, S2100) is carried out at timing different from that for printing the printing medium 90; however, as another embodiment, the ejectors 270 can be inspected on the basis of the electrical signal SW in response to residual vibration and the synthesized signal PW, during printing of the printing medium 90.

In the preceding first embodiment, during the decision process (Step S150) based on the synthesized signal PW the number of ejectors 270 under inspection is set to two, and in the second time period T2 for generating residual vibration, the application level of the drive signal COM is set to voltage V1; however, as other embodiments, the number of ejectors 270 under inspection, or the application level of the drive signal COM for generating residual vibration, can be modified appropriately. In so doing, a synthesized signal PW can be obtained at a signal level appropriate for inspection. As one example, by prompting the controller 100 to function as a synthesis quantity modifier, the number of ejectors 270 under inspection in the decision process (Step S150) can be modified in response to the application level of the drive signal COM for generating residual vibration. As a specific example, the number of ejectors 270 detected by the electrical signal HGND via the common electrical path 68 when the application level of the drive signal COM is a first level can be greater than the number of ejectors 270 detected by the electrical signal HGND via the common electrical path 68 when the application level of the drive signal COM is a second level stronger than the first. As another example, by prompting the controller 100 to function as an application level modifier, the application level of the drive signal COM for generating residual vibration can be modified in response to the number of ejectors 270 under inspection in the decision process (Step S150). As a specific example, the application level of the drive signal COM when the number of ejectors 270 detected by the electrical signal HGND via the common electrical path 68 is a first number can be stronger than the application level of the drive signal COM when the number of ejectors 270 detected by the electrical signal HGND via the common electrical path 68 is a second number greater than the first.

Also, in the preceding first embodiment, when establishing sets for inspection, in a case where the number "n" of nozzles 48 of each color is an even number, sets are established so that none of the n nozzles 48 overlap, or in a case where "n" is an odd number, are established with one of the n nozzles 48 overlapping (Step S110); however, as another embodiment, sets can be established further overlap of the n nozzles 48. As one example, when establishing sets for inspection from among a plurality of ejectors 270, a set of first and second ejectors 270 can be established, and a further set of the first and a third ejector 270 can be established. The application level of the drive signal COM when detecting only the first ejector 270 can be greater than the application level of the drive signal COM when detecting the first ejector 270 in the case of the set of the first and second ejectors 270. Also, a set of first and second ejectors 270 can be established, a further set of the first and a third ejector 270 can be established, and then a further set of the first and a fourth ejector 270, or a set of the third and the fourth ejector 270, can be established.

Also, in the preceding first embodiment, sets for inspection are established such that another ejector 270 is disposed between two ejectors 270 established as a set for inspection (Step S110); however, as another embodiment, sets for inspection can be established such that two or more neighboring ejectors 270 are established as a set for inspection. In the preceding embodiments, two ejectors 270 that eject the same color of ink (same type of liquid) are established as sets for inspection (Step S110); however, as another embodiment, two ejectors 270 that eject different colors of ink (different types of liquid) can be established as sets for inspection.

In the preceding first embodiment, a synthesized signal PW is detected on the basis of the electrical signal HGND of the common electrical path 68; however, as another embodiment, after individually detecting a plurality of electrical signals SW in response to residual vibration of two or more ejectors 270 established as a set for inspection, a synthesized signal PW can be calculated ex post facto, on the basis of data showing these detected electrical signals SW.

Also, in the preceding third embodiment, the application level of the drive signal for driving the driving elements in the ejectors 270 is the same in both the first inspection step (Step S2110) for identifying an ejector 270 for synthesis, and the second inspection step (Step S2210) for identifying an ejector 270 for inspection based on the synthesized signal PW; however, as another embodiment, the application level of the drive signal in the first inspection step (Step S2110) can be greater than the application level of the drive signal in the second inspection step (Step S2210). In so doing, the likelihood of an erroneous decision during identification of ejectors 270 for synthesis can be minimized.

Also, in the preceding third embodiment, in the second inspection step (Step S2210) for identifying an ejector 270 for inspection based on the synthesized signal PW, an ejector 270 decided to be in an ink-ejectable state is identified as a new candidate for synthesis; however, as another embodiment, the ejector 270 that was identified in the first inspection step (Step S2110) can continue to be employed as the candidate for synthesis, without updating the candidate for synthesis in the second inspection step (Step S2210). In so doing, a plurality of ejectors 270 under inspection can be inspected under identical conditions in the second inspection step (Step S2210).

Also, in the preceding third embodiment, in the second inspection step (Step S2210), a candidate for inspection is selected according to a positional relationship whereby another ejector 270 is disposed between the ejector 270 for synthesis and the ejector 270 under inspection (Step S2220); however, as another embodiment, a set for inspection in which the ejector 270 for synthesis and the ejector 270 under inspection are neighboring can be established. Also, in the preceding third embodiment, the inspection process (Step S2100) is executed for every ejector 270 ejecting the same color of ink; however, as another embodiment, two ejectors 270 that eject different colors of ink (different types of liquid) can be established as candidates for synthesis and for inspection.

Also, in the preceding third embodiment, the synthesized signal PW is detected on the basis of the electrical signal HGND of the common electrical path 68; however, as another embodiment, after individually detecting a plurality of electrical signals SW in response to residual vibration an ejector 270 for synthesis and an ejector 270 under inspection, a synthesized signal PW can be calculated ex post facto, on the basis of data showing these detected electrical signals SW.

In the preceding embodiments, an inkjet printer for ejecting ink was described as an example of a liquid ejecting device; however, the liquid for ejection by the liquid ejecting device of the invention is not limited to ink, and various types of liquids, as well as fluids of a solid dispersed in a liquid or a gas, are also acceptable. For example, the invention is not limited to printers of inkjet format, and can be implemented in printers of other formats. Application is possible as well in ejection devices employed in the manufacture of liquid crystal displays, organic EL (Electro Luminescence) displays, field emission displays (FED), and the like, and adapted to eject liquid bodies containing electrode materials, coloring matter, or other materials in a dispersed or dissolved state. Application is possible as well in ejection devices employed in the manufacture of bio chips, and adapted to eject liquids containing bioorganic compounds. Additionally, application is possible in ejection devices employed as precision pipettes, and adapted to eject a liquid as specimens. Further, application is possible in ejection devices for pinpoint ejection of lubricants into precision instruments such as clocks or cameras; or ejection devices for ejecting solutions of ultraviolet-curing resins or other transparent resins, for the purpose of forming very small semi-spherical lenses (optical lenses) for use in optical communication elements. Application is possible as well in ejection devices for ejecting etchant solutions for etching of wafers, or ejection devices for ejecting powders such as toner.

What is claimed is:

1. A liquid ejecting device for ejecting a liquid using driving elements driven through application of a drive signal, the liquid ejecting device comprising:

a plurality of driving elements;

a common electrical path electrically connected to the plurality of driving elements; and a detector electrically connected to the common electrical path, wherein the detector simultaneously detects, via the common electrical path, electrical signals output from each of the plurality of driving elements, the electrical signals corresponding to residual vibration remaining from driving of the driving elements, and the quantity of the plurality of driving elements undergoing detection of an electrical signal, via the common electrical path, when the application level of the drive signal is a first level exceeds the quantity of the plurality of driving elements undergoing detection of an electrical signal, via the common electrical path, when the application level of the drive signal is a second level that is stronger than the first level.

2. The liquid ejecting device according to claim 1, wherein the detector detects, via the common electrical path, an electrical signal output by any of the plurality of driving elements.

3. The liquid ejecting device according to claim 1, wherein the application level of the drive signal when the quantity of the plurality of driving elements undergoing detection of an electrical signal via the common electrical path is a first quantity is stronger than the application level of the drive signal when the quantity of the plurality of driving elements undergoing detection of an electrical signal via the common electrical path is a second quantity that is greater than the first quantity.

4. The liquid ejecting device according to claim 1, wherein the plurality of driving elements include a first driving element, a second driving element, and a third driving element, and the detector detects, via the common electrical path, an electrical signal output from the first driving element and an electrical signal output from the second driving element, and detects, via the common electrical path, an electrical signal output from the first driving element and an electrical signal output from the third driving element.

5. The liquid ejecting device according to claim 4, wherein the detector detects, via the common electrical path, an electrical signal output from the first driving element, and the application level of the drive signal applied to the first driving element in a case where an electrical signal output from the first driving element is detected is greater than the application level of the drive signal applied to the first driving element in a case where an electrical signal output from the first driving element and an electrical signal output from the second driving element are detected.

6. The liquid ejecting device according to claim 4, wherein the plurality of driving elements include a fourth driving element, and the detector detects, via the common electrical path, an electrical signal output from the first driving element and an electrical signal output from the fourth driving element.

7. The liquid ejecting device according to claim 4, wherein the plurality of driving elements includes a fourth driving element, and the detector detects, via the common electrical path, an electrical signal output from the third driving element and an electrical signal output from the fourth driving element.

8. The liquid ejecting device according to claim 1, wherein the liquid ejecting device includes a plurality of cavities, and cavities of driving elements that are not subjected to electrical signal detection via the common electrical path are disposed between cavities for ejecting a liquid by driving of the plurality of driving elements that are subjected to electrical signal detection via the common electrical path.

9. The liquid ejecting device according to claims 1, wherein liquids ejected by driving of the plurality of driving elements are of the same type.

10. An inspecting method by a liquid ejecting device that ejects a liquid using driving elements driven through application of a drive signal, the method comprising:

the liquid ejecting device being provided with a plurality of driving elements, a common electrical path electrically connected to the plurality of driving elements, and a detector electrically connected to the common electrical path;

driving the plurality of driving elements; and simultaneously detecting, via the common electrical path, electrical signals that are output from each of the plurality of driving elements, the electrical signals corresponding to residual vibration remaining from driving of the driving elements, wherein the quantity of the plurality of driving elements undergoing detection of an electrical signal, via the common electrical path, when the application level of the drive signal is a first level exceeds the quantity of the plurality of driving elements undergoing detection of an electrical signal, via the common electrical path, when the application level of the drive signal is a second level that is stronger than the first level.

11. A computer-readable media having stored thereon a computer program for prompting a computer to carry out a function for inspecting liquid ejection using a liquid ejecting device that ejects a liquid using driving elements driven by application of a drive signal, the liquid ejecting device being provided with a plurality of driving elements, a common electrical path electrically connected to the plurality of driving elements, and a detector electrically connected to the common electrical path;

wherein the program prompts the computer to carry out a function for driving the plurality of driving elements, a function for simultaneously detecting, via the common electrical path, electrical signals that are outputted from each of the plurality of driving elements, the electrical signals corresponding to residual vibration remaining from driving of the driving elements, and the quantity of the plurality of driving elements undergoing detection of an electrical signal, via the common electrical path, when the application level of the drive signal is a first level exceeds the quantity of the plurality of driving elements undergoing detection of an electrical signal, via the common electrical path, when the application level of the drive signal is a second level that is stronger than the first level.

* * * * *